US009056458B2

(12) United States Patent
Yoshimura et al.

(10) Patent No.: US 9,056,458 B2
(45) Date of Patent: Jun. 16, 2015

(54) LIQUID DISCHARGE HEAD AND RECORDING DEVICE USING SAME

(75) Inventors: Kazuya Yoshimura, Kyoto (JP); Takaaki Ichizono, Kyoto (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 14/113,363

(22) PCT Filed: May 28, 2012

(86) PCT No.: PCT/JP2012/063641

§ 371 (c)(1),
(2), (4) Date: Oct. 22, 2013

(87) PCT Pub. No.: WO2012/165378

PCT Pub. Date: Dec. 6, 2012

(65) Prior Publication Data

US 2014/0043388 A1 Feb. 13, 2014

(30) Foreign Application Priority Data

May 28, 2011 (JP) ..... 2011-119814
May 30, 2011 (JP) ..... 2011-120656
Mar. 14, 2012 (JP) ..... 2012-057293

(51) Int. Cl.
*B41J 2/17* (2006.01)
*B41J 2/045* (2006.01)
(Continued)

(52) U.S. Cl.
CPC ..... *B41J 2/04515* (2013.01); *B41J 2/055* (2013.01); *B41J 2/14233* (2013.01); *B41J 2202/11* (2013.01)

(58) Field of Classification Search
CPC ..... B41J 2/04581; B41J 2/04541; B41J 2/14; B41J 2/1433; B41J 2/1612; B41J 2/135; B41J 2002/14419; B41J 2002/14459
See application file for complete search history.

(56) References Cited

U.S. PATENT DOCUMENTS 5,963,234 A 10/1999 Miyazawa et al.
7,708,388 B2 * 5/2010 Chang ..... 347/68
8,057,018 B2 * 11/2011 Yazaki et al. ..... 347/68
(Continued)

FOREIGN PATENT DOCUMENTS

EP 0759361 A2 2/1997
EP 1160084 A1 12/2001
(Continued)

OTHER PUBLICATIONS

International Search Report, PCT/JP2012/063641, Aug. 9, 2012, 4 pp.

*Primary Examiner* — Lamson Nguyen
(74) *Attorney, Agent, or Firm* — Volpe and Koenig, P.C.

(57) ABSTRACT

A long liquid discharge head of the present invention includes a passage member 4 in one direction having a plurality of discharge holes 8 and a plurality of pressurizing chambers 10; a plurality of pressurizing sections 30 for pressurizing liquid in a plurality of the respective pressurizing chambers 10; and a long reservoir 540 in the one direction bonded along the passage member 4 and having a reservoir passage 42 for supplying the liquid to a plurality of the pressurizing chambers 10, and when viewed in the direction in which the reservoir 540 and the passage member 4 are bonded, the reservoir 540 includes a plurality of heat insulating sections (the reservoir passage 42 and a space 541*a*-4) extending in the one direction and a heat transfer section 541*a*-3 provided between a plurality of the heat insulating sections.

16 Claims, 11 Drawing Sheets

(51) Int. Cl.
*B41J 2/055* (2006.01)
*B41J 2/14* (2006.01)

(56) References Cited

U.S. PATENT DOCUMENTS

| | | | | |
|---|---|---|---|---|
| 8,864,287 | B2 * | 10/2014 | Huffman et al. | 347/68 |
| 2002/0033866 | A1 | 3/2002 | Cho et al. | |
| 2006/0262162 | A1 | 11/2006 | Sugahara | |
| 2008/0158323 | A1 | 7/2008 | Nishizaki | |
| 2010/0073433 | A1 | 3/2010 | Shimizu et al. | |

FOREIGN PATENT DOCUMENTS

| | | | |
|---|---|---|---|
| JP | 04144751 | A | 5/1992 |
| JP | 09314836 | A | 12/1997 |
| JP | 2002052715 | A | 2/2002 |
| JP | 2004209655 | A | 7/2004 |
| JP | 2006281527 | A | 10/2006 |
| JP | 2006347163 | A | 12/2006 |
| JP | 2008162144 | A | 7/2008 |
| JP | 2009083231 | A | 4/2009 |
| JP | 2010076176 | A | 4/2010 |
| JP | 2011079164 | A | 4/2011 |

* cited by examiner 2a
4
5
5a
21
51
52
52b
52a
41a
42
41a-2
42d
44
42c
41a-3
41b,c,d
42a
46
44

LIQUID DISCHARGE HEAD AND RECORDING DEVICE USING SAME

FIELD OF INVENTION

The present invention relates to a liquid discharge head for discharging an ink droplet and a recording device using the liquid discharge head.

BACKGROUND

In recent years, printers using an inkjet recording method, such as inkjet printers and inkjet plotters, have been widely used in not only printers for general consumers but also industrial purposes, such as formation of an electronic circuit, manufacturing of a color filter for a liquid crystal display, and manufacturing of an organic EL display.

Such printer using the inkjet recording method is provided with a liquid discharge head for discharging liquid as a printing head. For this type of printing head, a thermal method and piezoelectric method are commonly known. In the thermal method, a heater as a pressurizing means is provided in an ink passage filled with ink, the ink is heated and boiled with the heater to generate air bubbles in the ink passage, and the air bubbles pressurizes the ink, thereby causing the ink as an ink droplet to discharge from an ink discharge hole. In the piezoelectric method, a part of a wall of an ink passage filled with ink is bent and displaced by a displacing element to mechanically pressurize the ink in the ink passage, thereby causing the ink as an ink droplet to discharge from the ink discharge hole.

The liquid discharge head can employ either serial method or line method. In the serial method, recording is carried out while the liquid discharge head is moved in a direction (main scanning direction) orthogonal to a transport direction (sub scanning direction) of a recording medium. In the line method, recording is carried out on a recording medium transported in a sub scanning direction in a state where a liquid discharge head being longer in a main scanning direction than a recording medium is fixed. The line method has an advantage of permitting high speed recording because unlike the serial method, there is no need to move the liquid discharge head.

A known liquid discharge head includes, in addition to a liquid discharge head body having a piezoelectric actuator for pressurizing liquid so as to discharge the liquid from a passage member having a discharge hole and the discharge hole, a reservoir for temporarily storing the liquid so as to stably supply the liquid to the liquid discharge head body (for example, refer to Patent document 1). In the liquid discharge head, the reservoir is stacked on the side of the long liquid discharge head on which the piezoelectric actuator is bonded, and an FPC (Flexible Printed Circuit) for transmitting a signal to drive the piezoelectric actuator is pulled out from between the liquid discharge head and the reservoir.

In a reservoir passage of a reservoir of an accumulating discharge head described in Patent document 2, liquid introduced from an end of the long liquid discharge head is sent to the liquid discharge head body at the center of the liquid discharge head.

PRIOR ART DOCUMENTS

Patent Documents

Patent document 1: Japanese Unexamined Patent Publication No. 2005-169839

Patent document 2: Japanese Unexamined Patent Publication No. 2008-162144

SUMMARY

Problems to be Solved by the Invention

However, in the liquid discharge head described in Patent document 1, variation in discharge characteristics in the liquid discharge head may become large due to a difference in temperature in the longitudinal direction. This is due to that the temperature variation leads to variation in the viscosity of used liquid and characteristics of a pressurizing section for discharging liquid. Although the liquid discharge head may be equipped with a heater to stabilize temperature, since heat is radiated from ends in the longitudinal direction, the ends tends to be cooler than the central portion, generating variation in the discharge characteristics of the liquid discharge head due to temperature distribution.

The liquid discharge heads described in Patent documents 1 and 2 each have only one reservoir passage, and to discharge plural types of liquid from one liquid discharge head, the reservoir needs to have a plurality of reservoir passages. At this time, a plurality of the reservoir passages can be provided in parallel with each other. In this case, the width of one reservoir passage becomes small and therefore, even when the reservoir passage is provided with a damper, the sufficient damping effect cannot be exerted.

Thus, an object of the present invention is to provide a liquid discharge head that is hard to cause variation in temperature in a liquid discharge head, and a recording device using the liquid discharge head. Another object of the present invention is to provide a liquid discharge head capable of improving the damping effect of a damper and a recording device using the liquid discharge head.

Means for Solving the Problems

A liquid discharge head of the present invention includes a long passage member in one direction having a plurality of discharge holes and a plurality of pressurizing chambers connected to a plurality of the respective discharge holes; a plurality of pressurizing sections joined to the passage member pressurizing liquid in a plurality of the respective pressurizing chambers; and a long reservoir in the one direction bonded along the passage member and having a reservoir passage for supplying the liquid to a plurality of the pressurizing chambers, and when viewed in the direction in which the reservoir the passage member are bonded, the reservoir includes a plurality of heat insulating sections extending in the one direction and a heat transfer section provided between a plurality of the heat insulating sections.

A liquid discharge head of the present invention includes a long passage member in one direction having a plurality of discharge holes and a plurality of pressurizing chambers connected to a plurality of the respective discharge holes; a plurality of pressurizing sections joined to the passage member and pressurizing liquid in a plurality of the respective pressurizing chambers; and a long reservoir in the one direction bonded along the passage member and having a plurality of reservoir passages for supplying liquid to a plurality of the pressurizing chambers and a plurality of dampers facing a plurality of the respective reservoir passages. The reservoir passages each extend in the one direction, and have a broad section having a larger width from a central portion to one end than a width from the central portion to the other end, and a plurality of the reservoir passages are adjacent to each other in a direction intersecting the one direction, the broad sections of the adjacent reservoir passages are alternately disposed, and the dampers face the broad sections. A recording device of the present invention includes the liquid discharge head, a conveying section for conveying a record medium to the liquid discharge head, and a controller for controlling a plurality of the pressurizing sections.

Effects of the Invention

According to the present invention, the heat transfer section can improve heat conductivity in the longitudinal direction to reduce variation in temperature in the liquid discharge head. As a result, variation in discharge characteristics in the liquid discharge head is reduced. According to the present invention, the damping effect of a damper can be improved.

DETAILED DESCRIPTION OF THE PREFERRED EMBODIMENTS

Figure 1:
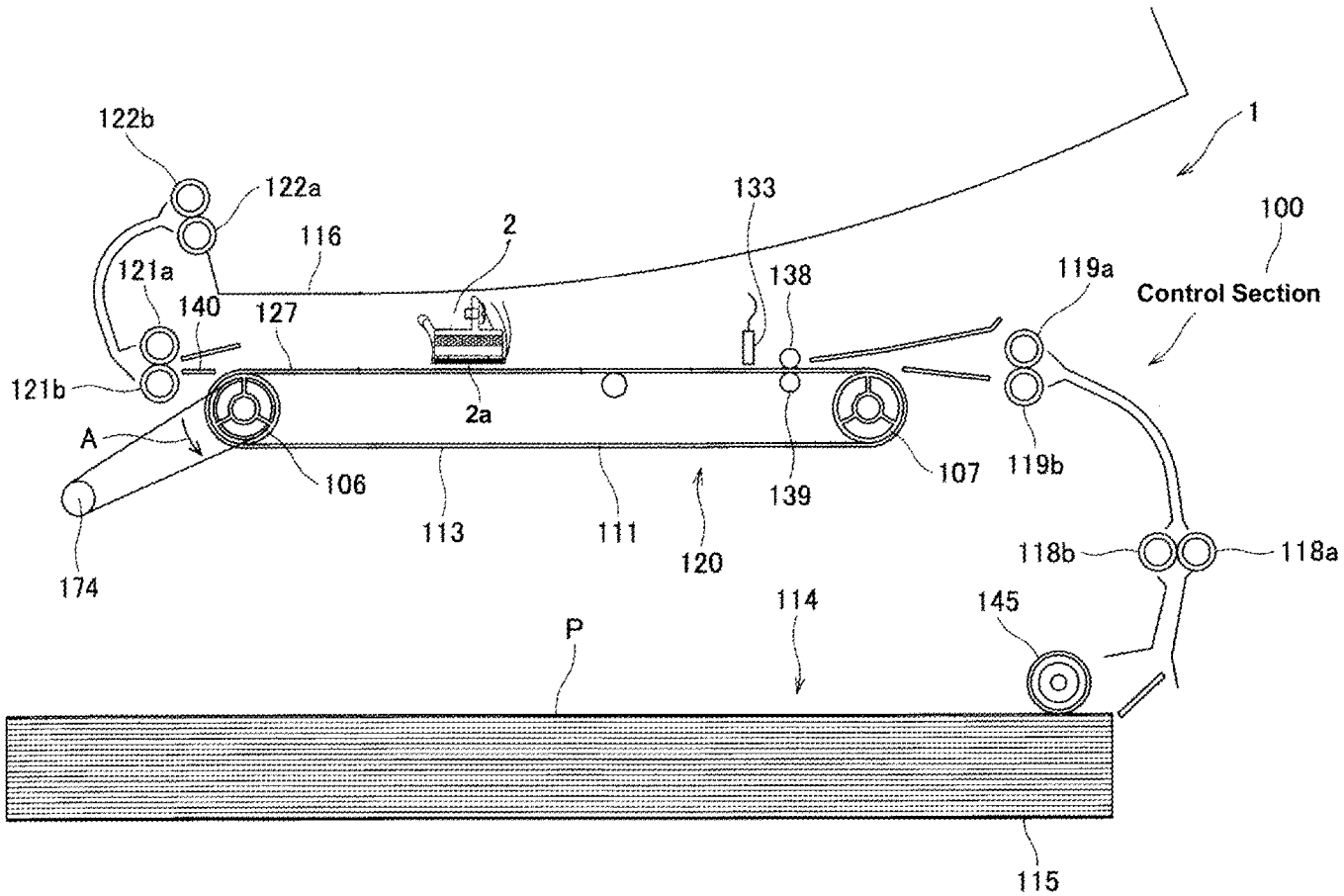
FIG. 1 is a schematic configuration view of a color inkjet printer as a recording device including a liquid discharge head in accordance with an embodiment of the present invention.

FIG. 1 is a schematic configuration view of a color inkjet printer as a recording device including a liquid discharge head in accordance with an embodiment of the present invention. The color inkjet printer 1 (hereinafter referred to as printer 1) has a liquid discharge head 2. The liquid discharge head 2 is fixed to the printer 1. The liquid discharge head 2 has a long shape extending from the near side toward the depth side in FIG. 1. The length direction may be also referred to as a longitudinal direction.

The printer 1 is provided with a sheet feeding unit 114, a conveying unit 120, and a sheet receiving section 116 in this order along a conveyance path of a printing sheet P. The printer 1 is provided with a controller 100 for controlling the operation of each part of the printer 1, for example, the liquid discharge head 2 and the sheet feeding unit 114.

The sheet feeding unit 114 has a sheet storage case 115 that can store a plurality of the printing sheets P and a sheet feeding roller 145. The sheet feeding roller 145 can send the uppermost printing sheet P among the printing sheets P stacked and stored in the sheet storage case 115 one by one.

Two pairs of feeding rollers 118*a* and 118*b*, and 119*a* and 119*b* are disposed along the conveyance path of the printing sheet P between the sheet feeding unit 114 and the conveying unit 120. The printing sheet P sent from the sheet feeding unit 114 is further sent to the conveying unit 120 under guidance of these feeding rollers.

The conveying unit 120 has an endless conveying belt 111 and two belt rollers 106 and 107. The conveying belt 111 is wound around the belt rollers 106 and 107. The conveying belt 111 is adjusted in length so as to be stretched with a predetermined tensile force when being wound around the two belt rollers. Thus, the conveying belt 111 is stretched without any slack along two parallel planes each including a common tangent of the two belt rollers. The plane closer to the liquid discharge head 2 among the two planes is a conveying surface 127 for conveying the printing sheet P.

As illustrated in FIG. 1, a conveying motor 174 is connected to the belt roller 106. The conveying motor 174 can rotate the belt roller 106 in a direction of an arrow A. The belt roller 107 can rotate in conjunction with the conveying belt 111. Accordingly, by driving the conveying motor 174 to rotate the belt roller 106, the conveying belt 111 moves in the direction of the arrow A.

A nip roller 138 and a nip receiving roller 139 are disposed near the belt roller 107 so as to sandwich the conveying belt 111 therebetween. The nip roller 138 is biased downward by a spring not illustrated. The nip receiving roller 139 below the nip roller 138 receives the nip roller 138 biased downward via the conveying belt 111. The two nip rollers are rotatably provided, and rotate in conjunction with the conveying belt 111.

The printing sheet P sent from the sheet feeding unit 114 to the conveying unit 120 is sandwiched between the nip roller 138 and the conveying belt 111. Thereby, the printing sheet P is pressed onto the conveying surface 127 of the conveying belt 111, and is fixed on the conveying surface 127. Then, with rotation of the conveying belt 111, the printing sheet P is conveyed toward the liquid discharge head 2. Adhesive silicone rubber may be applied to a peripheral surface 113 of the conveying belt 111. This can reliably fix the printing sheet P to the conveying surface 127.

The liquid discharge head 2 has a head body 2*a* at its lower end. The lower surface of the head body 2*a* is constituted of a discharge hole surface 4-1 having a lot of discharge holes for discharging liquid therefrom.

The discharge holes formed in one liquid discharge head 2 discharge ink droplets (ink) of four colors. Since the discharge holes discharging ink of each color from the liquid discharge head 2 are disposed at regular intervals in one direction (a direction that is parallel to the printing sheet P and is orthogonal to a direction in which the printing sheet P is conveyed, that is, the longitudinal direction of the liquid discharge head 2), each color can be printed in one direction without any gap. The colors of ink discharged from the liquid discharge head 2 are, for example, magenta (M), yellow (Y), cyan (C), and black (K). The liquid discharge head 2 is disposed with a slight gap between the discharge hole surface 4-1 as the lower surface of the head body 2*a* and the conveying surface 127 of the conveying belt 111.

The printing sheet P conveyed by the conveying belt 111 passes through the gap between the liquid discharge head 2 and the conveying belt 111. At this time, ink droplets are discharged from the head body 2*a* constituting the liquid discharge head 2 toward the upper surface of the printing sheet P. In this manner, a color image based on image data stored by the controller 100 is formed on the upper surface of the printing sheet P.

A peeling plate 140 and two pairs of feeding rollers 121*a* and 121*b*, and 122*a* and 122*b* are disposed between the conveying unit 120 and the sheet receiving section 116. The printing sheet P on which the color image is printed is conveyed to the peeling plate 140 by the conveying belt 111. At this time, the printing sheet P is peeled from the conveying surface 127 by the right end of the peeling plate 140. Then, the printing sheet P is sent to the sheet receiving section 116 by the feeding rollers 121*a* to 122*b*. In this manner, the printed printing sheets P are sequentially sent to the sheet receiving section 116 and are stacked on the sheet receiving section 116.

A sheet surface sensor 133 is provided between the liquid discharge head 2 located on the most upstream side in the conveying direction of the printing sheet P and the nip roller 138. The sheet surface sensor 133 is made of a light emitting element and a light receiving element, and can detect the front edge of the printing sheet P on the conveyance path. A detection result of the sheet surface sensor 133 is transmitted to the controller 100. The controller 100 can control the liquid discharge head 2, the conveying motor 174, and so on according to the detection result transmitted from the sheet surface sensor 133 such that conveyance of the printing sheet P is synchronized with printing of the image.

Next, the liquid discharge head 2 of the present invention will be described.

Figure 2:
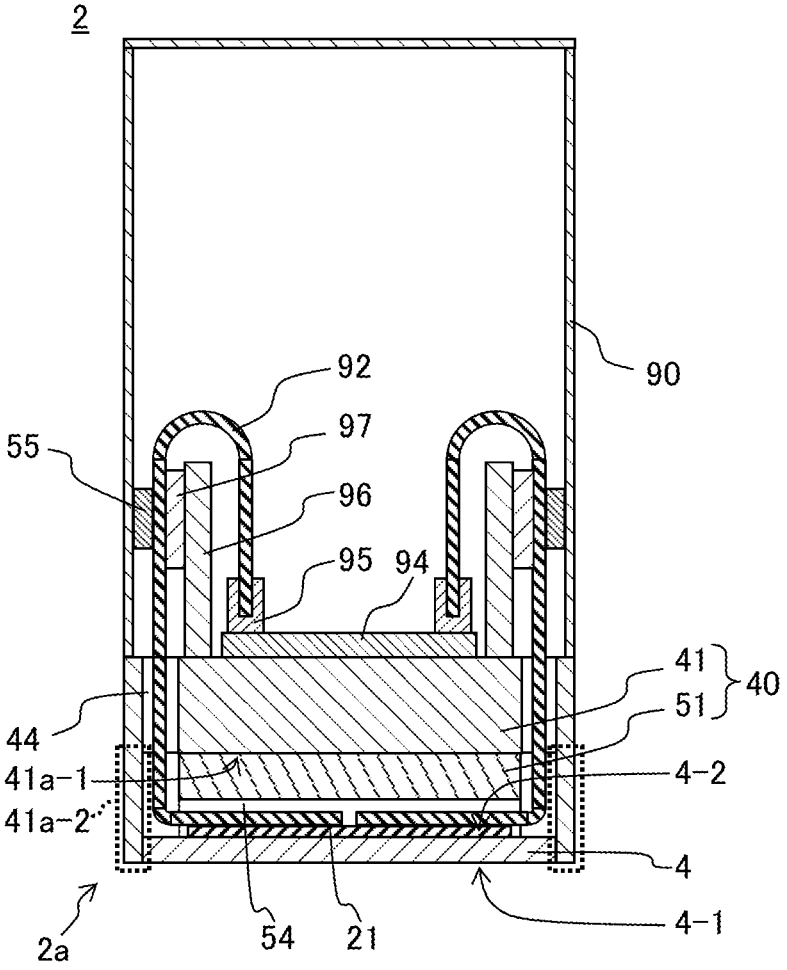
FIG. 2 is a vertical sectional view of the liquid discharge head in FIG. 1.
Figure 3:
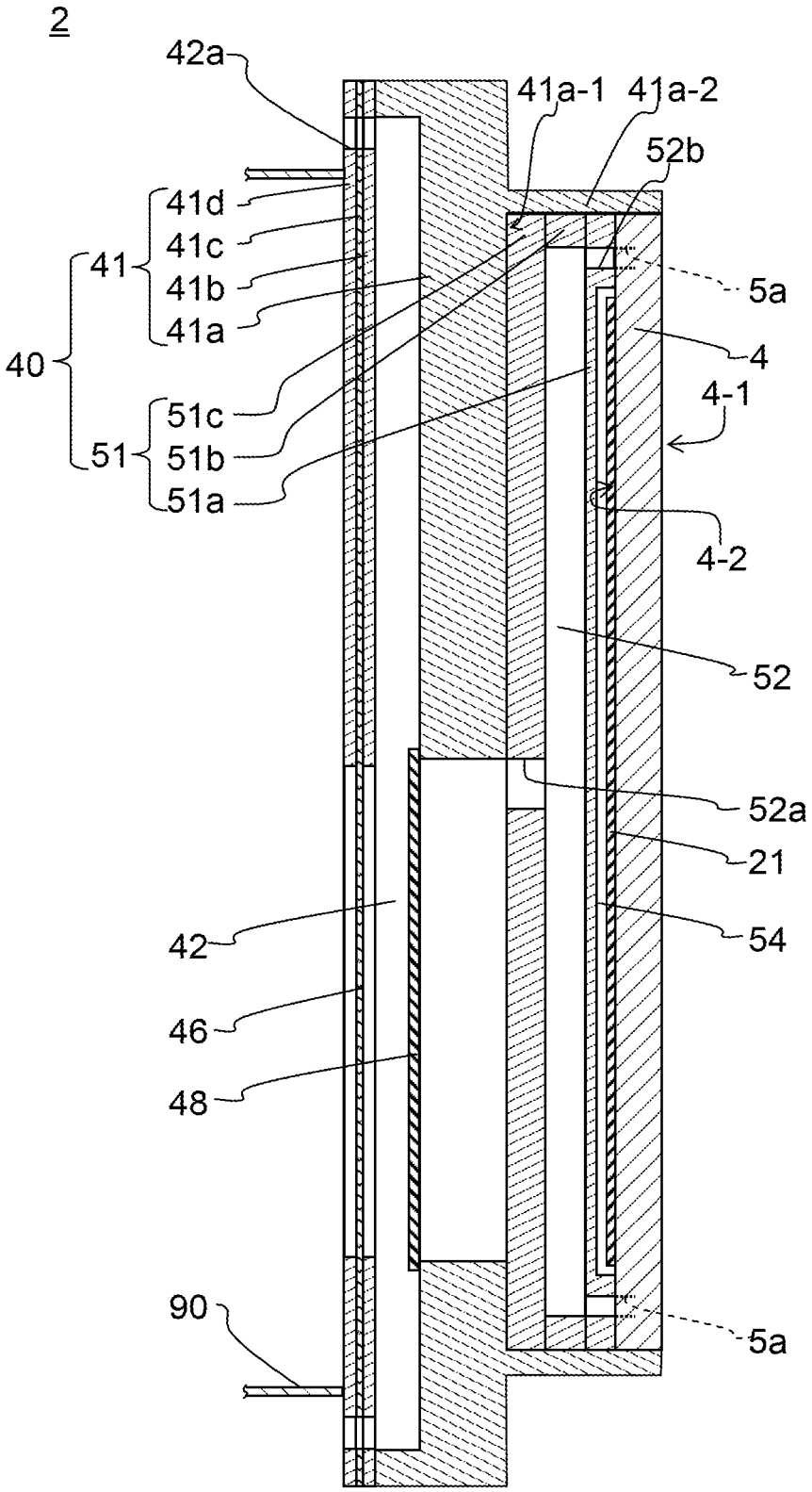
FIG. 3 is a partial vertical sectional view of the liquid discharge head in FIG. 1 when viewed in a direction shifted from the direction in FIG. 2 by 90 degrees.

FIG. 2 is a vertical sectional view of the liquid discharge head 2 in the direction orthogonal to the longitudinal direction. However, passages in a passage member 4 and a reservoir 40 are omitted. FIG. 3 is a vertical sectional view of the liquid discharge head 2 along the longitudinal direction. However, members located above the reservoir 40 and the passages in the passage member 4 are partially omitted.

Figures 4A, 4B, 4C, 4D:
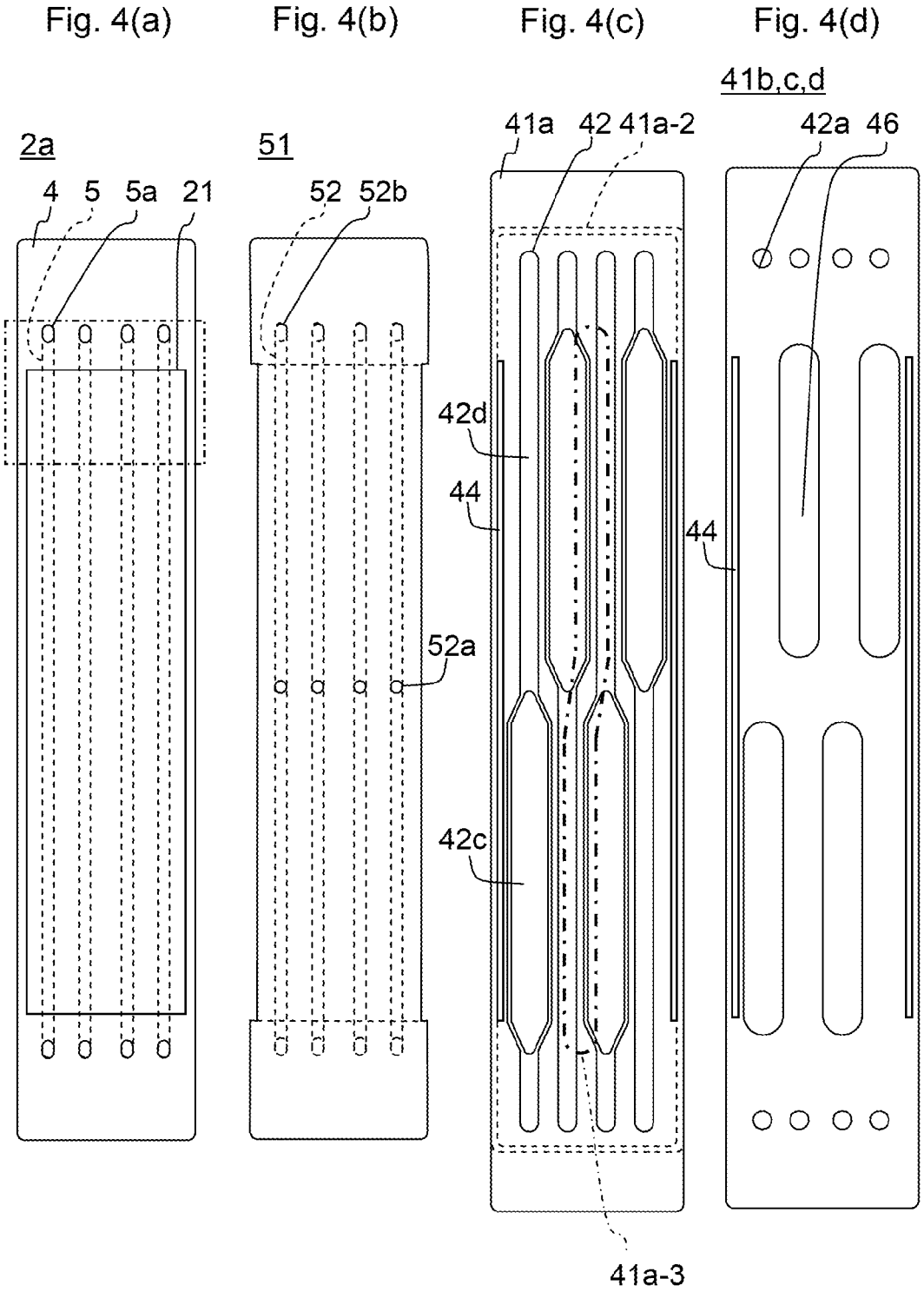
FIG. 4(*a*) is a plan view of a passage member and a piezoelectric actuator that constitute the liquid discharge head in FIG. 2, FIG. 4(*b*) is a plan view of a branch passage member constituting the liquid discharge head, and FIG. 4(*c*) and FIG. 4(*d*) are plan views of members constituting a reservoir of the liquid discharge head.
Figure 5:
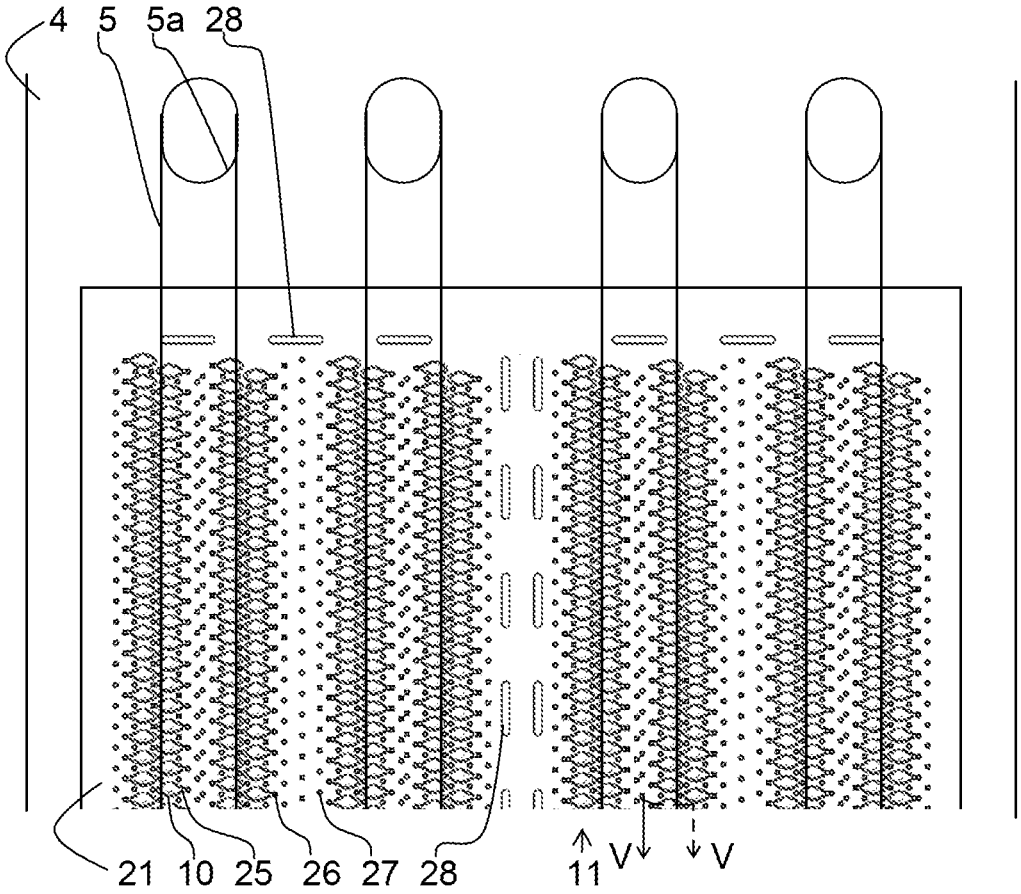
FIG. 5 is an enlarged view of a region surrounded by a dashed-dotted line in FIG. 4(*a*), and some passages are omitted for convenience of description.
Figure 6:
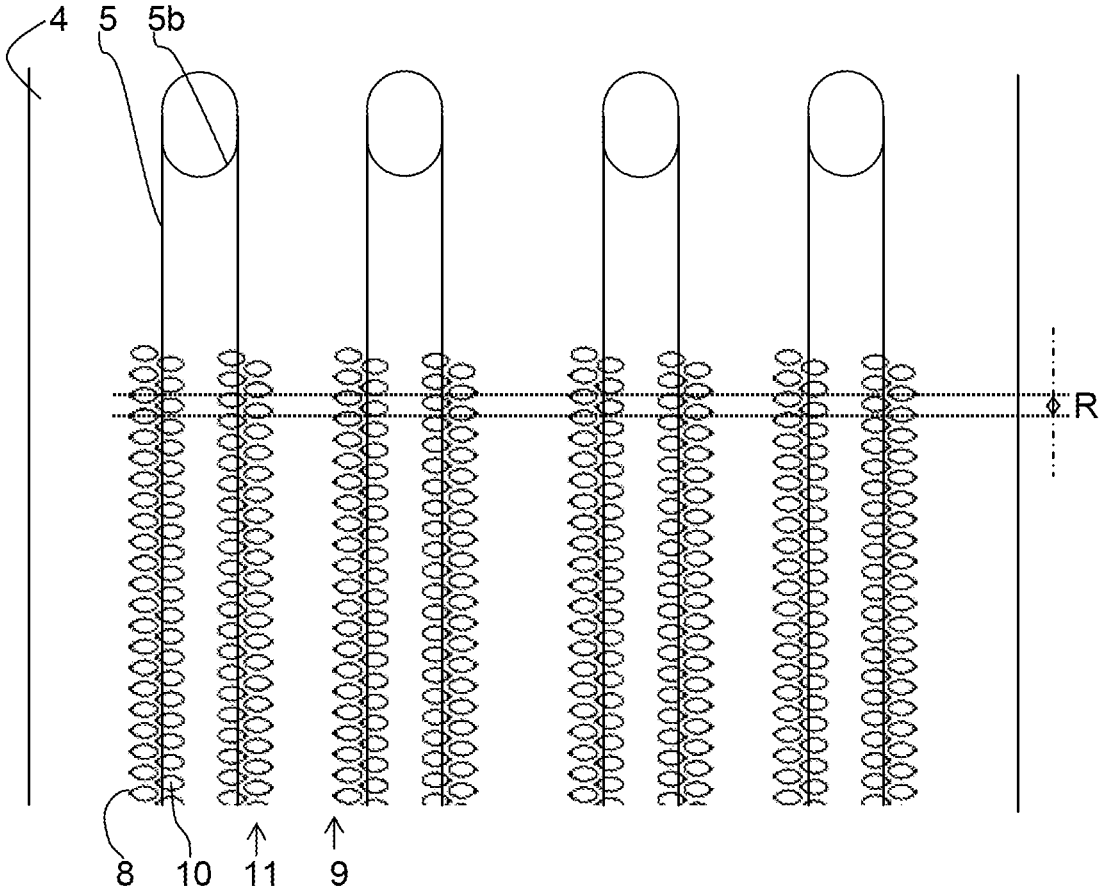
FIG. 6 is an enlarged view of a region surrounded by a dashed-dotted line in FIG. 4(*a*), and some passages are omitted for convenience of description.
Figure 7:
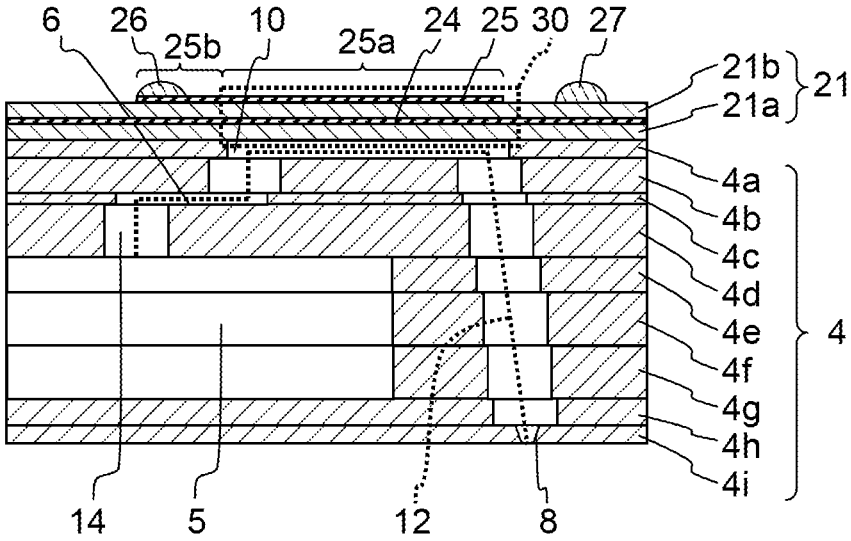
FIG. 7 is a vertical sectional view taken along a line V-V in FIG. 5.

FIG. 4(*a*) is a plan view of the head body 2*a*, and FIG. 4(*b*) is a plan view of a branch passage member 51. FIG. 4(*c*) and FIG. 4(*d*) are plan views of members constituting the reservoir 40, and FIG. 4(*d*) illustrates plates 41*b* and 41*d* and a damper plate 41*c* in FIG. 3, which are stacked and bonded to one another. The members illustrated in FIG. 4(*c*) and FIG. 4(*d*) are bonded to each other to constitute a reservoir body 41 as a part of the reservoir 40. FIG. 5 is an enlarged view of a region surrounded by a dashed-dotted line in FIG. 4(*a*), and some passages are omitted for convenience of description. FIG. 6 is an enlarged view of a region surrounded by a dashed-dotted line in FIG. 2(*a*), and some passages other than the omitted passage in FIG. 5 are omitted for convenience of description. In FIG. 5 and FIG. 6, for clearance of figures, a manifold (common passage) 5, discharge holes 8, and pressurizing chambers 10, which are located below a piezoelectric actuator board 21 and should be drawn in broken lines, are drawn in solid lines. FIG. 7 is a vertical sectional view taken along a line V-V in FIG. 5.

The liquid discharge head 2 includes the head body 2*a*, the reservoir 40, and a metal housing 90. The head body 2*a* and the reservoir 40 are long in the one direction, and are bonded along each other. The head body 2*a* includes the passage member 4 and the piezoelectric actuator board 21 having displacing elements (pressurizing sections) 30. The reservoir 40 includes the reservoir body 41 and the branch passage member 51.

The passage member 4 constituting the head body 2*a* includes the manifold 5 as a common passage, a plurality of the pressurizing chambers 10 connected to the manifold 5, and a plurality of the discharge holes 8 connected to a plurality of the respective pressurizing chambers 10, the pressurizing chambers 10 are opened to the upper surface of the passage member 4, and the upper surface of the passage member 4 is a pressurizing chamber surface 4-2. The upper surface of the passage member 4 has an opening 5*a* connected to the manifold 5, and liquid is supplied through the opening 5*a*.

The piezoelectric actuator board 21 including the displacing elements 30 is bonded to the upper surface of the passage member 4, and each displacing element 30 is located above the pressurizing chamber 10. A signal transmitting section 92 for transmitting a signal to each displacing element 30, such as an FPC (Flexible Printed Circuit), is connected to the piezoelectric actuator board 21.

The reservoir 40 is configured by joining the reservoir body 41 formed a reservoir passage 42 to the branch passage member 51 formed a branch passage 52. A supply hole 42*a* of the reservoir passage 42 is opened to the outside, and liquid supplied from the outside is supplied to the manifold 5 of the passage member 4 through the supply hole 42*a*, the reservoir passage 42, and the branch passage 52 in this order. The branch passage 52 may be omitted, and the reservoir passage 42 may be directly connected to the manifold 5.

The reservoir body 41 has a wall 41*a*-2 (shielding section) protruding downward from its lower surface, a concave section 41*a*-1 is surrounded with the wall 41*a*-2, and the branch passage member 51 and the head body 2*a* are disposed in the concave section 41*a*-1 in this order. The piezoelectric actuator board 21 is stored in a pressurizing-section storing section 54 as a space formed by the branch passage member 51, the passage member 4, and the wall 41*a*-2.

The passage member 4 is joined to the wall 41*a*-2 with a bonding agent, and the pressurizing-section storing section 54 is a substantially sealed space.

As described above, in this embodiment, the wall 41*a*-2 of the reservoir 40 is disposed so as to surround the passage member 4 of the head body 2*a*, and extends above the pressurizing chamber surface 4-2 bonded the piezoelectric actuator board 21 of the passage member 4. Therefore, it can be prevented that liquid mist generated during printing contacts the piezoelectric actuator board 21, the signal transmitting section 92, and the connection between the piezoelectric actuator board 21 and the signal transmitting section 92, causing short-circuit and corrosion.

In this embodiment, the reservoir 40 is provided with the wall 41*a*-2 surrounding the head body 2*a*, and the pressurizing-section storing section 54 is formed between the reservoir 40 and the passage member 10 of the head body 2*a*. However, the present invention is not limited to this. For example, a wall (shielding section) that protrudes upward from the pressurizing chamber surface 4-2 may be provided at each longitudinal end of the passage member 4, and a wall (shielding section) that protrudes downward may be provided at each lateral end of the reservoir 40. When the reservoir 40 is combined with the head body 2*a*, the wall of the reservoir 40 and the wall of the passage member 4 may constitute the pressurizing-section storing section 54 that stores and surrounds the piezoelectric actuator board 21, and by bonding a frame (shielding section) that surrounds the head body 2*a* to the passage member 4 of the head body 2*a*, and further bonding the frame to the reservoir 40 with a bonding agent, the passage member 4, the frame, and the reservoir 40 may constitute the pressurizing-section storing section 54. The walls and the frame that constitute the pressurizing-section storing section 54 on the side of the reservoir 40 may be partially notched. However, the upper surfaces of the notched walls and frame need to be located closer to the reservoir 40 than the pressurizing chamber surface 4-2 of the passage member 4, that is, above the pressurizing chamber surface 4-2.

The reservoir 40 has a vertically penetrating through hole 44 that communicates with the pressurizing-section storing section 54, and the signal transmitting section 92 for transmitting the signal to drive the displacing elements 30 passes through the through hole. The width of the through hole 44 is set to, for example, about 1 to 2 mm. It is preferred to provide the through hole 44 near the wall 41*a*-2 such that the inner surface of a part of the through hole communicates with the inner surface of the wall 41*a*-2 smoothly as much as possible. By providing the through hole 44 near the wall 41*a*-2, a step height between the inner surface of a part of the through hole 44 and the inner surface of the wall 41*a*-2 can be reduced to achieve smooth connection, thereby easily guiding the signal transmitting section 92 into the through hole 44. More preferably, the through hole 44 is provided in the reservoir 40 such that the inner surface of a part of the through hole 44 is flush with the inner surface of the wall 41*a*-2.

The pressing plate 96 having a heat-insulating elastic member 97 and a wiring board 94 mounted a connector 95 are fixed to the reservoir body 41. A driver IC 55 is mounted on the signal transmitting section 92.

A driving signal transmitted from the controller 100 to the wiring board 94 through a signal cable (not illustrated) is transmitted to the signal transmitting section 92 via the connector 95. The driver IC 55 mounted on the signal transmitting section 92 processes the driving signal, and the processed driving signal drives the displacing elements 30 of the piezoelectric actuator board 21 through the signal transmitting section 92 to press liquid in the passage member 4, thereby discharging ink droplets. Although the wiring board 94 may divide a discharge signal into a plurality of the driver IC 55 or rectify the discharge signal, the wiring board 94 may be omitted and the signal cable from the controller 100 may be directly connected to the signal transmitting section 92. The signal transmitting section 92 is an elastic band-like body, and has metal wiring therein. A part of the wiring is exposed on the surface of the signal transmitting section 92, thereby electrically connecting the signal transmitting section 92 to the connector 95, the driver IC 55, and the piezoelectric actuator board 21.

The driver IC 55 generates heat at the above-mentioned driving signal processing. Since the driver IC 55 is pressed onto the metal housing 90 by the pressing plate 96 and the heat-insulating elastic member 97 through the signal transmitting section 92, generated heat is transmitted to mainly the housing 90, and is rapidly transmitted to the entire housing 90, and is radiated to the outside. When the driver IC 55 is attached, the pressing plate 96 is bent, and a repulsive force of the bending presses the driver IC 55 onto the housing 90.

The reservoir body 41 is constituted by stacking a passage structure 41*a*, the flat plates 41*b* and 41*d*, and the damper plate 41*c*. The passage structure 41*a* has a thickness in the range of about 5 to 10 mm, and the flat plates 41*b* and 41*d* and the damper plate 41*c* have a total thickness in the range of about 0.5 to 2 mm. The wall 41*a*-2 formed on the lower surface of the passage structure 41*a* has a width in the range of 1 to 2 mm.

The passage structure 41*a* may be formed by metal, resin, ceramic, or the like, preferably, resin, and a passage structure having more complicated shape can be manufactured at low costs. On the condition that the passage structure 4 is integral with the wall 41*a*-2, by stacking the passage structure 4 and other flat plates, the liquid discharge head 2 having the substantially sealed pressurizing-section storing section 54 and the through hole 44 communicating with the pressurizing-section storing section 54 can be formed. Plates 40*b* and 40*d* may be formed by resin or metal, and are preferably formed by resin since they can be manufactured at lower costs, and cause no difference in thermal expansion coefficient between the plates and the reservoir body 40*a*.

The passage structure 41*a* constitutes a basic structure of the reservoir passage 42. By stacking the plate 41*b* above the passage structure 41*a* and the branch passage member 52 below the passage structure 41*a*, the reservoir passage 42 that extends in the longitudinal direction of the long reservoir body 41 and vertically penetrates the reservoir body 41 is substantially constituted. A filter 48 is provided at the middle of the reservoir passage 42 vertically penetrating the reservoir body 41 to suppress passage of foreign materials in liquid. The reservoir passage 42 extends from one longitudinal end to the other longitudinal end of the reservoir body 41, and the supply hole 42*a* of the reservoir passage, which is opened to the outside, is provided at each end of the reservoir passage 42, that is, at two positions. Thus, liquid can be first introduced from the one end, and gas and liquid can be discharged from other end, resulting in reduction in remaining gas in the passage. At printing, liquid is supplied from either end, and the other end is closed by a mechanism of the printer not illustrated. As a result, the liquid in the reservoir passage 42 mainly flows from the supply hole 42*a* of the reservoir passage 42, to which the liquid is supplied, to a supply hole 52*a* of the central branch passage, and hardly flows on the closed side.

A part of the inner wall of the reservoir passage 42 is a damper 46 formed of the damper plate 41*c* made of an elastically deformable material. Since the damper 46 is opened so as to be deformable toward the surface on the opposite side to the reservoir passage 42 of damper 46, the damper 46 can be elastically deformed, thereby changing the volume of the reservoir passage 42, and for example, even when the amount of discharged liquid rapidly increases, liquid can be stably supplied. For example, the damper plate 41*c* is made of resin or metal, and has a thickness in the range of about 5 to 30 μm.

In this embodiment, four reservoir passages 42 are separately provided so as to extend in the longitudinal direction, and be adjacent to each other in the direction orthogonal to the longitudinal direction. Although described later in detail, this enables one liquid discharge head 4 to discharge ink of four colors. A longitudinal central portion of each reservoir passage 42 of the reservoir body 41 is connected to the supply hole (central passage) 42*a* of the below-mentioned branch passage 52.

As the change in the volume of the reservoir passage 42 due to deformation of the damper 46 is larger, the rapid change in the flow rate can be addressed more suitably, and the damping effect is higher. In first introducing ink, when it is attempted to provide a plurality of the reservoir passages 42 so as to extend in the longitudinal direction of the reservoir body 41 and be adjacent to each other in the width direction of the reservoir body 41 such that air bubbles are hard to remain in the reservoir passages 42, the width of the damper 46 that faces the reservoir passages 42 becomes small. Since the amount of deformation of the damper 46 is greatly affected by the length in the short width direction, when the width of the damper is small, the damping effect is lowered.

Thus, in the reservoir passage 42, a passage from the central portion to one end, which is wider than a passage from the central portion to the other end, is provided as a broad section 42*c*, and a damper 48 is provided opposed to the broad section 42*c*. In the adjacent reservoir passages 42, the broad section 42*c* is provided as the opposite end side. In other words, in the adjacent reservoir passages 42, the broad section 42*c* and a narrow section 42*d* that is narrower than the broad section 42*c* are adjacent to each other. This can improve the damping effect of the damper 46. This is due to that, even with the dampers 46 having the same area, the wider damper has a larger amount of deformation, which means higher damping effect. By alternately disposing the broad section 42*c* and the narrow section 42*d* in the width direction of the reservoir 40, the width of the reservoir 40 can be prevented from increasing.

At printing, by supplying liquid from the side of the broad section 42*c*, the liquid is supplied from each end of the liquid discharge head 2. For this reason, when liquid of a temperature that is different from that of the liquid discharge head 2 is supplied, temperature distribution in the longitudinal direction of the liquid discharge head 2 is almost symmetrical, reducing non-uniformity of temperature distribution. Since the viscosity of liquid is generally dependent on temperature to some extent, the printing accuracy can be improved by averaging temperature distribution. In the case where a plurality of liquid discharge head 2 are aligned in the longitudinal direction to perform printing on a large area, temperature difference between both ends of the liquid discharge head 2 is small and therefore, lowering of printing accuracy can be prevented, for example, there is little possibility that the boundary between the adjacent liquid discharge head 2 appears in streaks due to difference in discharge characteristics, which is caused by temperature difference. To make the width of the broad section 42*c* large, the width of the narrow section 42*d* on the narrow width side is preferably small. The depth of the narrow section 42*d* can be set to a half of the passage structure 41*a* or more, preferably, three quarters of the passage structure 41*a* or more, increasing the flow rate.

Since the below-mentioned branch passage 52 is connected to the central passage 52*a* at the longitudinal central portion of the below-mentioned branch passage 52, in introducing liquid from one longitudinal end, even when the filter 48 is provided at the other end, the amount of liquid passing the filter 48 on the side of the other end becomes relatively small. Thus, when the width of the reservoir passage 42 to which liquid is supplied is increased, the area of the part effectively used as a filter can increase to increase throughput in the case where the filter 48 having the same opening ratio is used. Further, even when the passage is partially clogged with foreign materials, the function hardly deteriorates.

The branch passage member 51 is provided with the branch passage 52, and the supply hole (central passage) 52*a* of the central portion of the branch passage 52 communicates with the central portion of the reservoir passage 42 in the reservoir body 41. The branch passage 52 branches on the way, and is connected to the opening 5*a* of the manifold 5 in the passage member 4.

By providing the branch passage 52 and supplying liquid from the both ends of the manifold 5 to the passage member 4, lack of supplied liquid can be prevented. As compared to the case where liquid is supplied from one end of the manifold 5, difference in pressure loss, which is caused when liquid flows through the manifold 5, can be cut about by half, reducing variation in discharge characteristics of the liquid. To reduce difference in pressure loss, the liquid can be supplied near the center of the manifold 5, or at a few positions in the manifold 5 on the way. However, with such configuration, the width of the liquid discharge head 2 becomes large, and the area where the discharge holes 8 are arranged in the width direction also becomes large. As a result, the effect of the deviation of the angle at which the liquid discharge head 2 is attached to the printer 1 on the printing result increases, which is unpreferable. In the case of printing using a plurality of the liquid discharge heads 2, since the area where the entire discharge holes 8 of a plurality of the liquid discharge heads 2 increases, the effect of the accuracy of relative positions of a plurality of the liquid discharge heads 2 on the printing result becomes large, which is unpreferable. For this reason, to decrease the width of the liquid discharge head 2 and reduce difference in pressure loss, it is preferred to supply liquid from both ends of the manifold 5. The branch passage 52 may be omitted, and the reservoir passage 42 may be directly connected to the opening 5*a* of the manifold 5.

To reduce the pressure loss, preferably, positions of both longitudinal ends of the branch passage 52 are set to be the same as those of both ends of the manifold 5 in a plan view, and the both ends of the branch passage 52 are connected to the both ends of the manifold 5 with a passage linearly extending downward.

Since the supply hole (central passage) 52*a* of the branch passage 52 is formed in the central portion in the longitudinal direction, a difference in length of the passages to the manifold 5 connected at a plurality of positions can be made relatively small, stabilizing supply of liquid. The central portion herein refers to a central ⅓ portion between both ends of the reservoir passage 42. By setting the area where the central passage 52*a* is provided to a central 1/10 portion between the both ends, the difference in length of branched branch passage 52 can be further reduced.

A concave section is provided between both ends of the long branch passage member 51 bonded to the passage member 4, and the piezoelectric actuator board 21 is stored in the concave section. With such configuration, it is possible to use an extremely large piezoelectric actuator board 21 that has a width of 80% of the passage member 4 or more and a length of 80% of the length between the openings 5*a* of the manifold or more, and includes a 4-inch individual electrode 25 constituting the displacing element 30. Thus, since the number of bonded piezoelectric actuator boards 21 can be reduced, the process can be simplified and variation in the displacing elements 30 between the piezoelectric actuator boards 21, which is caused by use of a plurality of the piezoelectric actuator boards 21 can be eliminated. As a result, variation in discharge can be reduced.

The branch passage member 51 is configured by stacking a plurality of rectangular plates 51*a* to 51*c*. The branch passage 52 branches immediately below the supply hole 52*a* of the branch passage 52 in one and the other longitudinal directions, and the branch passages 52 are directed toward the lower side near longitudinal ends, and are connected to the openings 5*a* of the manifold 5 of the passage member 4 through outflow holes 52*b* of the branch passage 52. The branched branch passages 52 have the substantially same length of the passage to the manifold 5. Thus, since temperature change and pressure change of liquid supplied from the outside are transmitted to a plurality of the connecting portions with the manifold 5 with a small time lag, variation in discharge characteristics of ink droplets in the liquid discharge head 2 can be further reduced. The term "substantially same" means that the shortest passage length is 80% of the longest passage length or more, preferably, 90% of the longest passage length or more. It is preferred that the branch passages 52 have the substantially same length as well as the substantially same cross-sectional area. The term "substantially same cross-sectional area" means that difference in cross-sectional area of the passages at the position from a liquid insertion hole 60*b* of the branch passage 52 is 20% or less, preferably, 10% or less.

The head body 2*a* has the flat plate-like passage member 4, and one piezoelectric actuator board 21 including the displacing element 30 on the passage member 4. The piezoelectric actuator board 21 is rectangular in a plan view, and is disposed on the upper surface of the passage member 4 such that the long side extends in the longitudinal direction of the passage member 4.

The four manifolds 5 are formed in the passage member 4. Each manifold 5 is an oblong body extending in the longitudinal direction of the passage member 4, and the opening 5*a* of the manifold 5 is formed at each end on the upper surface of the passage member 4. In this embodiment, the four manifolds 5 are separately provided, and each are connected to the branch passage 52 at the opening 5*a*.

The passage member 4 is formed by spreading a plurality of the pressurizing chambers 10 in a two-dimensional way. The pressurizing chamber 10 is a substantially rhombic hollow region having rounded corners in a plan view. The pressurizing chamber 10 is opened to the pressurizing chamber surface 4-2 as the upper surface of the passage member 4.

The pressurizing chambers 10 are connected to one manifold 5 via an individual supply passage 14. Two pressurizing chamber rows 11, each are a row of the pressurizing chambers 10 connected to one manifold 5, are provided at each side of the manifold 5, that is, four pressurizing chamber rows 11 in total are provided so as to be along the manifold 5. Accordingly, as a whole, 16 pressurizing chamber rows 11 are provided. An interval between the pressurizing chambers 10 in the longitudinal direction in each pressurizing chamber row 11 is the same, which is 37.5 dpi. The pressurizing chamber 10 at the end of each pressurizing chamber row 11 is a dummy and thus, is not connected to the manifold 5. Due to the dummy, the structure (rigidity) around the pressurizing chamber 10 inner than the pressurizing chamber 10 at the end becomes close to the structure (rigidity) of the other pressurizing chambers 10, reducing difference in liquid discharge characteristics.

The pressurizing chambers 10 in each pressurizing chamber row 11 are disposed in a staggered pattern such that their angular sections are located between the adjacent pressurizing chamber rows 11. The pressurizing chambers 10 connected to one manifold 5 constitute a pressurizing chamber group, and there are four pressurizing chamber group. The pressurizing chambers 10 in each pressurizing chamber group are located at the same relative position, and the pressurizing chamber groups are slightly displaced in the longitudinal direction. These pressurizing chambers 10 are disposed over the whole region opposed to the piezoelectric actuator board 21 on the upper surface of the passage member 4, even with a slight larger interval portion between the pressurizing chamber groups. That is, the pressurizing chamber group 9 constituted of these pressurizing chambers 10 occupies the substantially same dimension and shape as the piezoelectric actuator board 21 occupies. The opening of each pressurizing chamber 10 is closed by bonding the piezoelectric actuator board 21 to the upper surface of the passage member 4.

Descenders connected to the discharge holes 8 opened to the discharge surface 4-1 as the lower surface of the passage member 4 extend from corners opposed to corners to which the individual supply passage 14 of the pressurizing chambers 10 is connected. The descender extends in the direction in which the diagonal line of the pressurizing chamber extends in a plan view. That is, arrangement of the discharge holes 8 in the longitudinal direction is the same as that of the pressurizing chambers 10. In each pressurizing chamber row 11, the pressurizing chambers 10 are aligned at intervals of 37.5 dpi, and the pressurizing chambers 10 connected to one manifold 5 are disposed at intervals of 150 dpi in the longitudinal direction as a whole. Further, since the pressurizing chambers 10 connected to the four manifold 5 are disposed in displaced manner at intervals of 600 dpi in the longitudinal direction, the liquid pressurizing chambers 10 are formed at intervals of 600 dpi in the longitudinal direction as a whole. Since arrangement of the discharge holes 8 in the longitudinal direction are the same as that of the liquid pressurizing chambers 10 as described above, the interval between the discharge holes 8 in the longitudinal direction is also 600 dpi.

In other words, when the discharge holes 8 are projected so as to be orthogonal to a virtual straight line parallel to the length of the passage member 4, four discharge holes 8 connected to each manifold 5, that is, 16 discharge holes 8 in total, are disposed at regular intervals of 600 dpi in a range R of the virtual straight line illustrated in FIG. 6. Thus, by supplying ink of the same color to all of the manifolds 5, an image with a resolution of 600 dpi in the longitudinal direction can be formed. The four discharge holes 8 connected to one manifold 5 are disposed at regular intervals of 150 dpi in the range R of the virtual straight line. Thus, by supplying ink of different colors to the different manifolds 5, an image of four colors at the resolution of 150 dpi in the longitudinal direction may be formed as a whole. In this case, by using more four liquid discharge heads 2 to cause each liquid discharge head 2 to supply ink of four colors to the manifolds 5 at different positions, an image of four colors at the resolution of 600 dpi may be formed. Further, by using two liquid discharge heads 2 to cause each liquid discharge head 2 to supply ink of each color to the manifolds 5 at different positions, an image of four colors at the resolution of 300 dpi may be formed. In this manner, ink of the same color aligned on the record medium P in the main scanning direction is discharged from the different liquid discharge heads 2 and moreover, positions of the manifolds 5 in the liquid discharge head 2 are different from each other. For this reason, variation in liquid discharge characteristics, which is caused for each liquid discharge head 2, and discharge variation with the same tendency reflecting a variation caused by the positions of the manifolds 5 in each liquid discharge head 2 are hard to occur, achieving an image of good quality.

The individual electrode 25 is formed at the position opposed to each pressurizing chamber 10 on the upper surface of the piezoelectric actuator board 21. The individual electrode 25 is slightly smaller than the pressurizing chamber 10, and includes an individual electrode body 25*a* having the substantially same shape as the pressurizing chamber 10 and a drawing electrode 25*b* drawn from the individual electrode body 25*a*. Like the pressurizing chamber 10, the individual electrode 25 constitutes an individual electrode row and an individual electrode group. A common-electrode surface electrode 28 electrically connected to a common electrode 24 is formed on the upper surface of the piezoelectric actuator board 21. Two rows of the common-electrode surface electrodes 28 are formed in the lateral central portion of the piezoelectric actuator board 21 along the longitudinal direction, and one row of the common-electrode surface electrodes 28 are formed near the longitudinal end along the lateral direction. The illustrated common-electrode surface electrodes 28 each are intermittently formed in a straight line, but may be continuously formed in a straight line. The two signal transmitting sections 92 are disposed on the piezoelectric actuator board 21 from two long sides of the piezoelectric actuator board 21 toward the center, and are bonded. The common-electrode surface electrodes 28 are connected at ends of the signal transmitting sections 92(front end and a longitudinal end of the piezoelectric actuator board 21), and since the common-electrode surface electrode 28 and a common-electrode connecting electrode formed thereon are larger in area than the drawing electrode 25*b* and a connecting electrode 26 formed thereon, the signal transmitting sections 92 are hard to peel off from the ends.

The discharge holes 8 are disposed at positions other than the area opposed to the manifold 5 disposed on the lower surface of the passage member 4. The discharge holes 8 are disposed in the area opposed to the piezoelectric actuator board 21 on the lower surface of the passage member 4. These discharge holes 8 as one group occupy the region having the substantially same dimension and shape as the piezoelectric actuator board 21, and can displace the corresponding displacing elements 30 of the piezoelectric actuator board 21 to discharge ink droplets.

The passage member 4 included in the head body 2*a* has a stacked structure formed of a plurality of plates. These plates are a cavity plate 4*a*, a base plate 4*b*, an aperture plate 4*c*, a supply plate 4*d*, manifold plates 4*e* to 4*g*, a cover plate 4*h*, and a nozzle plate 4*i*, in this order from the upper surface of the passage member 4. These plates have a lot of holes. Each plate has a thickness in the range of about 10 to 300 μm and thus, the accuracy of forming holes can be increased. The plates are positioned and stacked such that the holes communicate with each other to constitute an individual passage 12 and the manifold 5. In the head body 2*a*, the pressurizing chambers 10 are disposed on the upper surface of the passage member 4, the manifolds 5 are disposed on the inside of the lower surface of the passage member 4, and the discharge holes 8 are formed in the lower surface, so that the sections constituting the individual passage 12 are adjacent to each other at different positions, and the manifold 5 are connected to the discharge holes 8 through the pressurizing chambers 10.

The holes formed in each plate will be described below. These holes are as follows. First, the hole is the pressurizing chamber 10 formed on the cavity plate 4*a*. Second, the hole is a through hole constituting the individual supply passage 14 from one end of the pressurizing chamber 10 to the manifold 5. This through hole is formed in each plate of the base plate 4*b* (specifically, inlet of the pressurizing chamber 10) to the supply plate 4*c* (specifically, outlet of the manifold 5). The individual supply passage 14 includes an aperture 6 formed in the aperture plate 4*c*, which is a portion having a small sectional area.

Third, the hole is a through hole constituting a passage that communicates from the other end of the pressurizing chamber 10 to the discharge hole 8, and the through hole will be hereinafter referred to as descender (partial passage). The descender is formed in each plate of the base plate 4*b* (specifically, outlet of the pressurizing chamber 10) to the nozzle plate 4*i* (specifically, discharge hole 8). Fourth, the hole is a through hole constituting the manifold 5. The through hole is formed in each of the manifold plates 4*e* to 4*g*.

The first to fourth through holes are connected to each other to constitute the individual passage 12 extending from an inlet of liquid from the manifold 5 (outlet of the manifold 5) to the discharge hole 8. The liquid supplied to the manifold 5 is discharged from the discharge hole 8 through a following path. First, the liquid directs upward from the manifold 5 to one end of the aperture 6 through the individual supply passage 14. Next, the liquid horizontally moves in the extending direction of the aperture 6 to the other end of the aperuture 6. Then, the liquid moves upward and reaches one end of the pressurizing chamber 10. Thereafter, the liquid horizontally moves in the extending direction of the pressurizing chamber 10, and reaches the other end of the pressurizing chamber 10. Then, the liquid gradually moves in the horizontal direction, and advances mainly downward and toward the discharge hole 8 opened to the lower surface.

Like the passage member 4, the branch passage member 51 is manufactured by rolling, is processed into predetermined shape by etching or grinding, and is stacked and adhered onto the plates 51*a* to 51*c* to provide a liquid passage 52 and a concave section as the pressurizing-section storing section 54 that stores the piezoelectric actuator. The plates 51*a* to 51*c* each have a thickness in the range of about 0.3 to 3 m, for example.

The piezoelectric actuator board 21 has a stacked structure formed of two piezoelectric layers 21*a* and 21*b*. These piezoelectric layers 21*a* and 21*b* each have a thickness of about 20 μm. The thickness from the lower surface of the piezoelectric layer 21*a* of the piezoelectric actuator board 21 to the upper surface of the piezoelectric layer 21*b* is about 40 μm. Any of the piezoelectric layers 21*a* and 21*b* extends over a plurality of the pressurizing chambers 10. These piezoelectric layers 21*a* and 21*b* are made of a ferroelectric lead zirconate titanate (PZT) ceramic material.

The piezoelectric actuator board 21 has the common electrode 24 made of metal material such as an Ag—Pd-based and the individual electrode 25 made of metal material such as an Au-based. As described above, the individual electrode 25 includes the individual electrode body 25*a* opposed to the pressurizing chamber 10 on the upper surface of the piezoelectric actuator board 21, and the drawing electrode 25*b* drawn from the individual electrode body 25*a*. The connecting electrode 26 is formed at one end of the drawing electrode 25*b*, and in a region drawn from the region opposed to the pressurizing chamber 10. The connecting electrode 26 is made of silver-palladium including, for example, glass frit, has a thickness of about 15 μm, and is convex-shaped. The connecting electrode 26 is electrically connected to an electrode provided in the signal transmitting section 92. Although described later in detail, a driving signal is transmitted from the controller 100 to the individual electrode 25 through the signal transmitting section 92. The driving signal is transmitted at certain cycle in synchronized with the conveying speed of the recording medium P. When the piezoelectric actuator board 21 formed on the connecting electrode 26 is staked and bonded onto the passage member 4, a dummy connecting electrode 27 is also formed such that the bonding pressure is transmitted through the connecting electrode 26 and the dummy connecting electrode 27, resulting in that distribution of the applied pressure becomes uniform to prevent occurrence of an unjoined portion and a loosely-bonded portion. Although the dummy connecting electrode 27 need not be connected to the signal transmitting section 92, by connecting the dummy connecting electrode 27 to the signal transmitting section 92, the connection strength between the piezoelectric actuator board 21 and the signal transmitting section 92 can be increased.

The common electrode 24 is formed in the substantially whole region between the piezoelectric layer 21*a* and the piezoelectric layer 21*b* in the surface direction. That is, the common electrode 24 extends so as to cover all of the pressurizing chambers 10 opposed to the piezoelectric actuator board 21. The common electrode 24 has a thickness of about 2 μm. The common electrode 24 is connected to the common-electrode surface electrode 28 on the piezoelectric layer 21*b* so as to avoid the group of individual electrodes 25 via a via hole formed in the piezoelectric layer 21*b*, and is grounded to be held at a ground potential. Like the lot of individual electrodes 25, the common-electrode surface electrode 28 is connected to another electrode on the signal transmitting section 92.

By selectively transmitting a predetermined driving signal to the individual electrodes 25 as described below, pressure is applied to liquid in the pressurizing chambers 10 corresponding to the individual electrodes 25. Thereby, ink droplets are discharged from the corresponding liquid discharge holes 8 through the individual passage 12. That is, the portion of the piezoelectric actuator board 21, which is opposed to the corresponding pressurizing chamber 10, corresponds to the individual displacing element 30 corresponding to each pressurizing chamber 10 and liquid discharge hole 8. That is, in the stacked body consisting of two piezoelectric ceramic layers, the displacing element 30 as the piezoelectric actuator using the structure as illustrated in FIG. 5 as unit structure is constituted of the vibrating plate 21*a*, common electrode 24, piezoelectric layer 21*b*, and individual electrode 25, which are located immediately above the pressurizing chamber 10, for each pressurizing chamber 10, and the piezoelectric actuator board 21 includes a plurality of the displacing elements 30 as the pressurizing sections. In this embodiment, the amount of liquid discharged from the liquid discharge holes 8 in one discharge operation is about 5 to 7 pl (picoliter).

A lot of the individual electrodes 25 are separately electrically-connected to the controller 100 via the signal transmitting section 92 and wiring so as to individually control its potential. When the individual electrode 25 and the common electrode 24 have different potentials and an electric field is applied to the piezoelectric layer 21*b* in the polarization direction, the portion to which the electric field is applied acts as an active section distorted due to the piezoelectric effect. With this configuration, when the controller 100 sets the individual electrode 25 to have a determined positive or negative potential with respect to the potential of the common electrode 24 such that the electric field and polarization are oriented in the same direction, a portion (active section) sandwiched between the electrodes of the piezoelectric layer 21*b* contracts in the surface direction. On the contrary, since the piezoelectric layer 21*a* as a nonactive layer is not affected by the electric field, the piezoelectric layer 21*a* does not spontaneously contract to restrict deformation of the active section. As a result, a difference in distortion in the polarization direction occurs between the piezoelectric layer 21*b* and the piezoelectric layer 21*a*, resulting in that the piezoelectric layer 21*b* is deformed (unimorph-deformed) so as to protrude toward the pressurizing chambers 10.

In an actual driving procedure in this embodiment, the potential of the individual electrode 25 is previously set to be higher than the potential of the common electrode 24 (hereinafter referred to as high potential) and at each discharge request, the potential of the individual electrode 25 is set to the same potential as that of the common electrode 24 once (hereinafter referred to as low potential) and after that, is returned to the high potential at a predetermined timing. Thus, at the timing when the potential of the individual electrode 25 becomes the low potential, the piezoelectric ceramic layers 21*a* and 21*b* are returned to the original shape, and the volume of the pressurizing chambers 10 increases from the volume in the initial state (the state where both the electrodes have different potentials). At this time, a negative pressure is applied to the pressurizing chambers 10, causing liquid to be sucked from the manifold 5 into the pressurizing chambers 10. After that, at the timing when the potential of the individual electrode 25 is returned to the high potential, the piezoelectric ceramic layers 21*a* and 21*b* are deformed so as to protrude toward the pressurizing chambers 10, and the volume of the pressurizing chambers 10 decreases, resulting in that the pressure in the pressurizing chambers 10 becomes a positive pressure, increasing the pressure applied to liquid to discharge ink droplets. That is, to discharge ink droplets, the driving signal including a pulse using the high potential as a reference is transmitted to the individual electrode 25. The pulse width is ideally AL (Acoustic Length) that is a time length during which a pressure wave propagates from the aperture 6 to the discharge holes 8. As a result, when the inside of the pressurizing chambers 10 is reversed from the negative pressure state to the positive pressure state, both pressures are combined to generate a larger pressure, thereby discharging ink droplets.

In gradation printing, gradation is expressed according to the number of ink droplets continuously discharged from the discharge holes 8, that is, the amount (volume) of ink droplets adjusted by the number of times of discharging of ink droplets. For this reason, ink droplets are continuously discharged the number of times corresponding to designated gradation expression, from the discharge hole 8 corresponding to a designated dot region. Generally, when liquid is continuously discharged, it is preferred that an interval between pulses supplied to discharge ink droplets is set to AL. Thereby, a remaining pressure wave of the pressure occurred when ink droplets are discharged last time coincides with a pressure wave of the pressure occurring when ink droplets are discharged next in cycle, and these pressure waves are superimposed, amplifying the pressure to discharge ink droplets. In this case, it is estimated that the speed of the ink droplets discharged later increases, and impact points of the ink droplets becomes closer, which is preferable.

Subsequently, liquid discharge heads in accordance with other embodiment of the present invention will be described with reference to FIGS. 8(*a*) to 8(*c*). Liquid discharge heads 202, 302, and 402 illustrated in FIGS. 8(*a*) to 8(*c*) have the same basic configuration as that illustrated in FIGS. 1 to 7, except for configuration of passage structures 241*a*, 341*a*, 441*a* of the reservoir body 41. The same sections are given with the same reference numerals and description thereof is omitted.

Figure 8A:
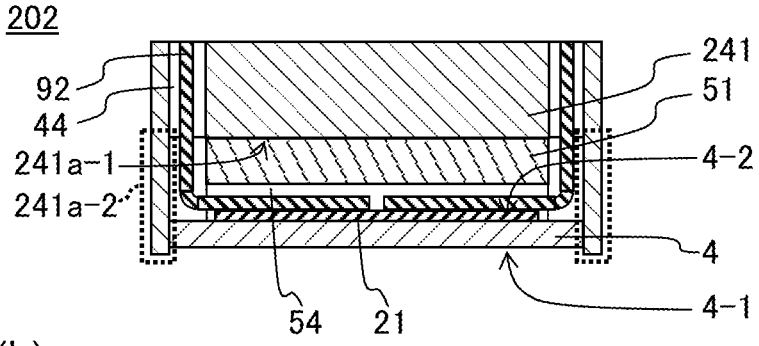
FIGS. 8(*a*) to 8(*c*) are partial vertical sectional views of another liquid discharge head body of the present invention.
Figure 8B:
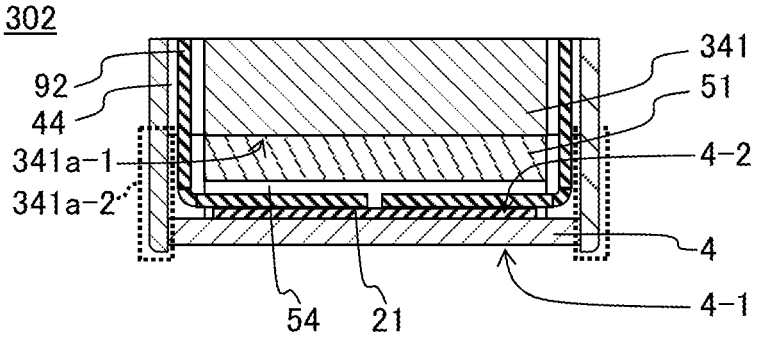
Figure 8C:
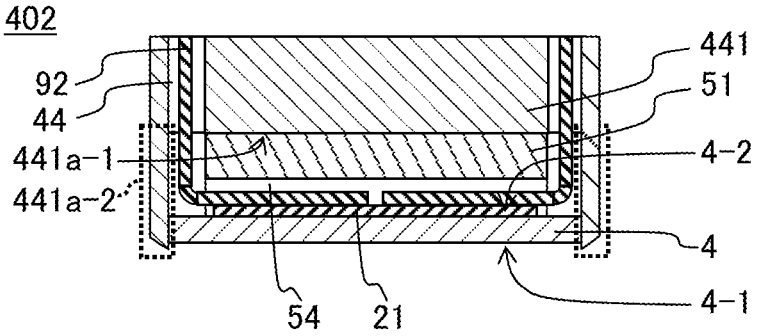

In the liquid discharge head 202 illustrated in FIG. 8(*a*), a front end of a wall 241*a*-2 constituting the pressurizing-section storing section 54 protrudes downward further from the discharge hole surface 4-1 of the head body 2*a*. By protruding the front end of the wall 241*a*-2 further from the discharge hole surface 4-1, it can be prevented that the record medium P hits against the discharge hole surface 4-1, thereby deforming the discharge holes 8 or damaging a water-repellent film formed on the discharge hole surface 4-1 to change discharging of liquid. This effect can be acquired by protruding the front end of the wall 241*a*-2 further from at least a part of the surrounding of the discharge hole surface 4-1. When the wall 241*a*-2 is formed on the entire long side of the discharge hole surface 4-1, which is orthogonal to the direction in which the liquid discharge head 202 and the record medium P move relatively to each other, the effect of protecting the discharge hole surface 4-1 can be improved. The discharge hole surface 4-1 can be further protected by protruding the front end of the wall 241*a*-2 from the entire circumference of the discharge hole surface 4-1. The entire side surface of the passage member 4 is covered with the wall 241*a*-2 by protruding the front end of the wall 241*a*-2 from the entire circumference of the discharge hole surface 4-1. For this reason, when the passage member 4 is formed by stacking a plurality of the plates, even if adhesion of each plate is insufficient, the liquid becomes difficult to be leaked to outside preventing a printing failure. By setting the protruding amount of the front end of the wall 241*a*-2 from the discharge hole surface 4-1 to 0.2 mm or more, the effect of protecting the discharge hole surface 4-1 can be improved. By setting the protruding amount to 0.5 mm or less, a step between the discharge hole surface 4-1 and the protruding portion can be reduced so as not to constitute an obstacle in wiping the discharge hole surface 4-1.

With such configuration, it is no need to assemble another member for protecting the discharge hole surface 4-1 and moreover, merely by bonding the discharge head 2*a* and the reservoir 40, substantially sealed space can be ensured as the pressurizing-section storing section 54 and the protrusion for protecting the discharge hole surface 4-1 can be provided.

In the liquid discharge head 302 illustrated in FIG. 8(*b*), the front end of the wall 241*a*-2 constituting the pressurizing-section storing section 54 as a space for storing the piezoelectric actuator board 21 protrudes downward further from the discharge hole surface 4-1, and the outer edge of the front end of the wall 241*a*-2 is chamfered. Therefore, damage of the record medium P can be suppressed.

In the liquid discharge head 402 illustrated in FIG. 8(*c*), the front end of the wall 241*a*-2 constituting the pressurizing-section storing section 54 as a space for storing the piezoelectric actuator board 21 protrudes downward further from the discharge hole surface 4-1, and the front end surface of the wall 241*a*-2 is an inclined surface inclined from the inner side surface to the outer side surface. Therefore, damage of the record medium P can be suppressed.

In summary, in the case where the liquid discharge head 2 includes the passage member 4 having a plurality of the discharge holes 8 and a plurality of the pressurizing chambers 20 connected to a plurality of the respective discharge holes 8, a plurality of the pressurizing sections 30 that are bonded to the passage member 4 and pressurize liquid in a plurality of the pressurizing chambers 10, and a shielding section 41*a*-2 that is bonded along the passage member 4 and protrudes from the pressurizing chamber surface 4-2 to which the pressurizing sections 30 of the passage member 4 are bonded, the shielding section can suppress short-circuit and corrosion due to mist.

In the case where the passage member 4 has the flat discharge hole surface 4-1 in which a plurality of the discharge holes 8 are opened, and at least a part of a shielding section 341*a*-2 protrudes further from the discharge hole surface 4-1, the discharge hole surface 4-1 can be protected against external shock.

In the case where the discharge hole surface 4-1 is surrounded with the shielding section 341*a*-2, and the shielding section 341*a*-2 protrudes over the entire circumference of the discharge hole surface 4-1 further from the discharge hole surface 4-1, the discharge hole surface 4-1 can be further protected. It is preferred that the front end surface of the shielding section on the discharge hole surface side, which is not opposed to the discharge hole, is chamfered.

In the case where the liquid discharge head 2 includes the reservoir passage 42 that supplies liquid to a plurality of the pressurizing chambers 30, the reservoir 40, a part of which becomes a shielding section 41*a*-3, and the pressurizing-section storing section 54 that stores a plurality of the pressurizing sections 30 between the reservoir 40, the passage member 4 and the shielding section 41*a*-3, the reservoir 40 also suppress the entry of mist.

In the case where the liquid discharge head 2 includes the reservoir passage 42 that supplies liquid to a plurality of the pressurizing chambers 10, the reservoir 40, a part of which becomes a shielding section 41*a*-3, and the pressurizing-section storing section 54 that stores a plurality of the pressurizing sections 30 between the reservoir 40 and the passage member 4, the reservoir 40 also suppress the entry of mist, and merely by bonding the passage member 4 to the reservoir 40, the shielding section 41*a*-3 can be attached to the liquid discharge head 2, simplifying the manufacturing process.

In the case where the reservoir 40 includes the through hole 44 connected to the pressurizing-section storing section 54 and the signal transmitting section 92 that passes through the through hole 44 and transmits the signal to drive a plurality of the pressurizing sections 30, the signal transmitting section 92 and contacts between the signal transmitting section 92 and a plurality of the pressurizing sections 30 can be protected against short-circuit and corrosion, and the signal transmitting section 92 can be pulled around above the reservoir 40.

In the case where the passage member 4 is long in one direction and includes the common passage 5, the common passage 5 extends in the one direction of the passage member 4 and is connected to a plurality of the pressurizing chambers 10, the reservoir 40 is long in the one direction and includes the branch passage 52, the branch passage 52 extends in the one direction of the reservoir 40, the central portion of the branch passage 52 is connected to the central portion of the reservoir passage 42, and both ends of the branch passage 52 each are connected to the common passage 5 of the passage member 4, by supplying liquid from both ends of the common passage 5, supply of the liquid can be stabilized, and the difference in length between the common passage 5 and the both ends of the branch passage 52 is reduced and thus, the supply conditions become more uniform.

In the case where the passage member 4 and the reservoir 40 each are provided with a plurality of the independent common passage 5 and reservoir passages 42, liquid of different colors can be supplied and discharged, achieving multicolor printing.

In the case where the head body 2*a* is long in one direction, a temperature difference in the longitudinal direction easily occurs. However, as illustrated in FIG. 4(*c*), since the heat transfer section 41*a*-3 is present between a plurality of the heat insulating sections extending in the longitudinal direction in the reservoir 40, heat is easily transferred in the longitudinal direction, decreasing variation in temperature in the head body 2*a*. When viewed in the bonding direction in which a reservoir 540 and the passage member 4 are bonded, that is, in a plan view of the flat plate-like reservoir 540, the reservoir passage 42 is present between the heat transfer section 41*a*-3 and the outer wall of the reservoir 40, which extends in the longitudinal direction. Since liquid such as water filled in the reservoir passage 42 has a lower thermal conductivity than the heat transfer section 41*a*-3 made of metal or the like, the reservoir passage 42 acts as the heat insulating section that prevents heat from escaping from the heat transfer section 41*a*-3 to the outside along the outer wall extending along the longitudinal direction, promoting heat transfer in the longitudinal direction.

The reservoir 40 may be wholly made of a high heat-transfer material such as metal. The passage structure 41 is basically made of plastic to prepare the heat transfer section 41*a*-3, and the high heat-transfer material such as metal in the form of column is added, further increasing the ratio of heat transferred in the longitudinal direction. Thus, the device can be manufactured at lower costs as compared to the case where the passage structure 41 is made of metal and processed by grinding or the like to finish its complicated shape.

In the case where a heater is attached to the reservoir 40 to heat the head up to about 40 to 60 oC, since heat dissipates from both ends in the longitudinal direction, even when the heater is attached to the substantially entire principle surface of the reservoir 40, the temperature at the both ends of the head body 2*a* tends to be lower than the temperature at the center of the head body 2*a*. In the case where no heat transfer section 41*a*-3 is present, a temperature difference of about 2 to 5 oC in the longitudinal direction may occur. However, since the viscosity of liquid and displacement characteristics of the displacing elements 30 vary to some extent depending on temperature, the temperature difference may vary the discharging property. The presence of the heat transfer section 41*a*-3, though depending on other members, can limit the temperature difference in the longitudinal direction to about 1 oC or lower.

By providing the heat transfer section 41*a*-3 in the central portion of the reservoir in the width direction that is the lateral direction, the temperature difference in the lateral direction can be reduced. The provision of the heat transfer section 41*a*-3 in the central portion in the lateral direction means that the heat transfer section 41*a*-3 overlaps a region having a width that is ½ of the central width in the lateral direction (that is, a region from the end in the lateral direction to ¼ to ¾), preferably, a region having a width that is ¼ of the central width (that is, a region from the end in the lateral direction to ⅜ to ⅝).

To reduce the temperature difference in the passage member 4, which has a large effect on printing results, it is preferred to connect both ends of the reservoir 40 to respective both ends of the passage member 4. In this manner, heat is transferred mainly from the both ends of the reservoir 40 to the both ends of the passage member 4, and is offset with temperature distribution of the entire liquid discharge head 2 in the longitudinal direction, further reducing the temperature difference in the passage member 4.

In the case where the reservoir 40 and the passage member 4 are bonded so as to surround the circumference of the passage member 4 when viewed in the direction in which the reservoir 40 is bonded to the passage member 4, since heat is transferred from the reservoir 40 to the entire circumference of the passage member 4, the temperature difference in the passage member 4 can be further reduced.

Figure 9:
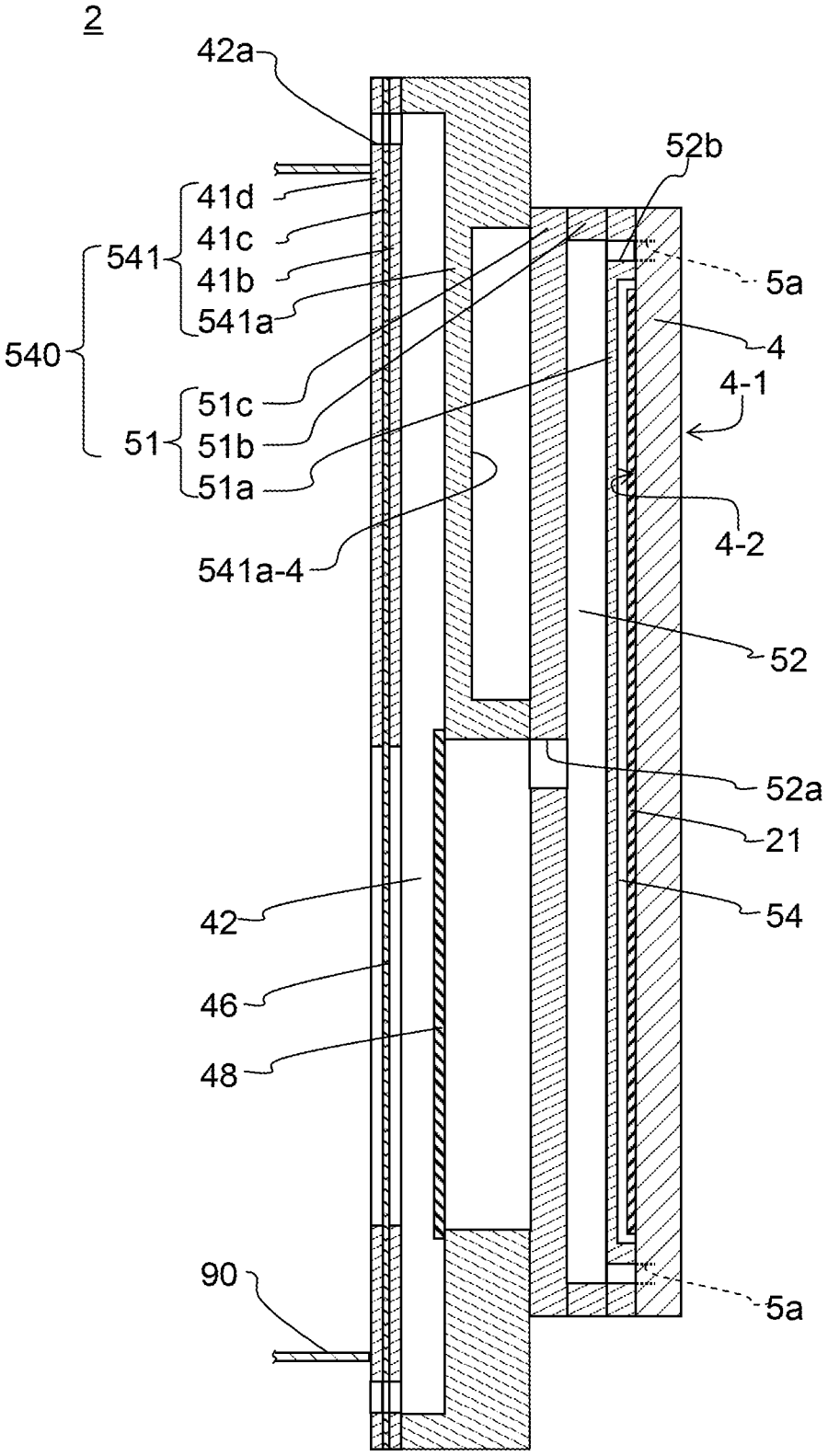
FIG. 9 is a partial vertical sectional view of a liquid discharge head body in accordance with another embodiment of the present invention.
Figure 10A:
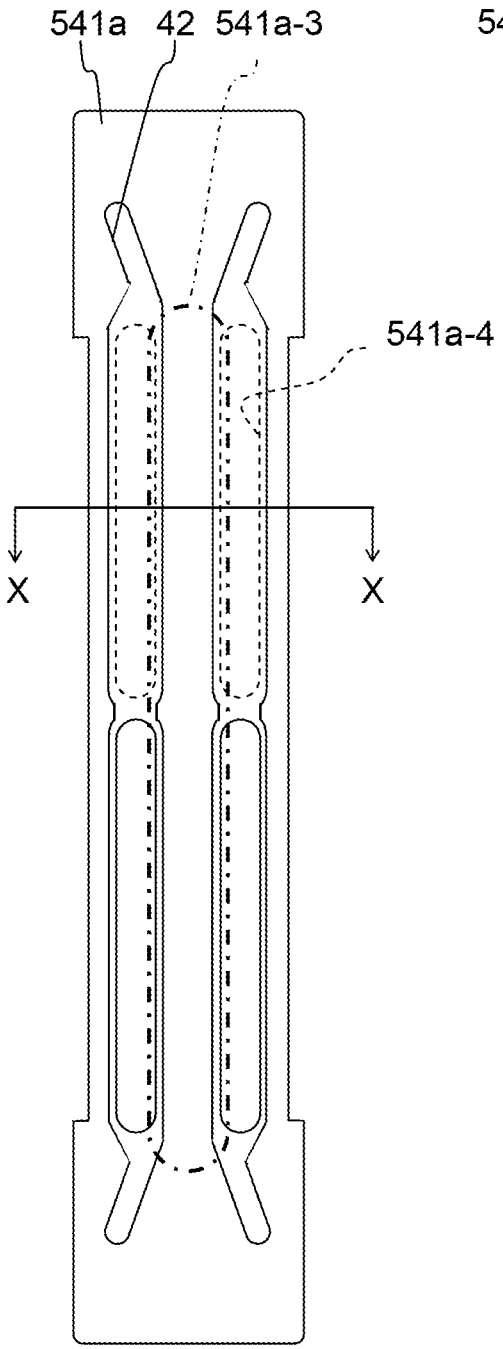
FIG. 10(*a*) is a plan view of a member constituting a reservoir of the liquid discharge head illustrated in FIG. 9, and FIG. 10(*b*) is a vertical sectional view taken along a line X-X in FIG. 10(*a*).
Figure 10B:
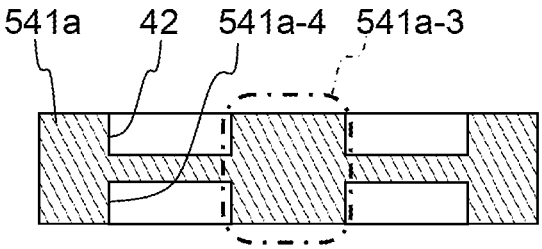

FIG. 9, FIG. 10(*a*), and FIG. 10(*b*) illustrate a liquid discharge head 2 in accordance with another embodiment of the present invention. FIG. 9 is a partial vertical sectional view of the head body 2, FIG. 10(*a*) is a plan view of a member constituting the reservoir 540 of the liquid discharge head in FIG. 9, and FIG. 10(*b*) is a vertical sectional view taken along a line X-X in FIG. 9(*a*). In these figures, the substantially same sections as those in the liquid discharge head in FIGS. 2 to 7 are given the same reference numerals and description thereof is omitted.

The liquid discharge head has two reservoir passages 42, two branch passages 52, and two manifolds 5 as common passages. The reservoir passages 42 each are connected to the respective branch passages 52, and the branch passages 52 branch on the way and are connected to the respective manifolds 5. Each manifold is connected to the pressurizing chambers connected to a plurality of the respective discharge holes 8 disposed at intervals of 300 dpi. Thus, printing of two colors at 300 dpi can be achieved by supplying ink of different colors to the two reservoir passages 42, and printing at 600 dpi can be achieved by supplying ink of the same color to the two reservoir passages 42.

Also in the liquid discharge head, a heat transfer section 541*a*-3 extends in the longitudinal direction of the reservoir 540, promoting heat transfer in the longitudinal direction rather than the lateral direction.

The reservoir passage 42 is present between the heat transfer section 541*a*-3 and the outer wall of the reservoir 540, which extends along the longitudinal direction, to suppress heat transfer. The reservoir 540 is provided with a space 541*a*-4, and the space 541*a*-4 acts as a heat insulating section that suppress heat transfer between the heat transfer section 541*a*-3 and the outer wall of the reservoir 540 along the longitudinal direction. That is, since both the reservoir passage 42 and the space 541*a*-4 are provided between the heat transfer section 541*a*-3 and the outer wall of the reservoir 540 along the longitudinal direction, and function as the heat insulating sections, the ratio of heat transferred in the longitudinal direction can be increased. A member having a lower heat conductivity than the reservoir 540 may be inserted into the space 541*a*-4. For example, an elastic body may be inserted to suppress resonance of the liquid discharge head 2, which is caused by discharging.

The heat insulating section may be formed of either the reservoir passage 42 or the space 541*a*-4. However, when it is attempted to constitute the heat insulating section of only the space 541*a*-4, the ratio of the space 541*a*-4 to the reservoir 540 except for the reservoir passage 42 increases, lowering space use efficiency. When it is attempted to constitute the heat insulating section of only the reservoir passage 42, an unnecessary passage must be formed in efficiently supplying liquid and preventing bubbles from flowing to the passage member 4, which impairs the primary function of the reservoir passage 42. Accordingly, it is preferred to combine the reservoir passage 42 with the space 541*a*-4 to form the heat insulating section.

The heat insulating section may be provided continuously or intermittently as long as it is present between the heat transfer section 541*a*-3 and the lateral outer wall of the reservoir 540 along the longitudinal direction. By continuously providing the heat insulating section in regions other than regions between the reservoir passages 42 and between the reservoir passage 42 and the space 541*a*-4, through which different liquid can flow, heat transfer in the lateral direction can be further suppressed.

In the case where the heater is attached to the head body 2*a*, the heater is preferably attached to the reservoir 540 having the heat transfer section 541*a*-3. In this case, preferably, the heater is attached along the longitudinal direction, and has a length extending from one end to the other end in the longitudinal direction. Generally, even when the heater is attached, since a large amount of heat dissipates from the both longitudinal ends of the head body 2*a*, temperature at the both ends tends to be low. As described above, however, the heat transfer section 541*a*-3 transfers heat in the longitudinal direction, reducing variation in temperature distribution in the longitudinal direction.

Figure 11A:
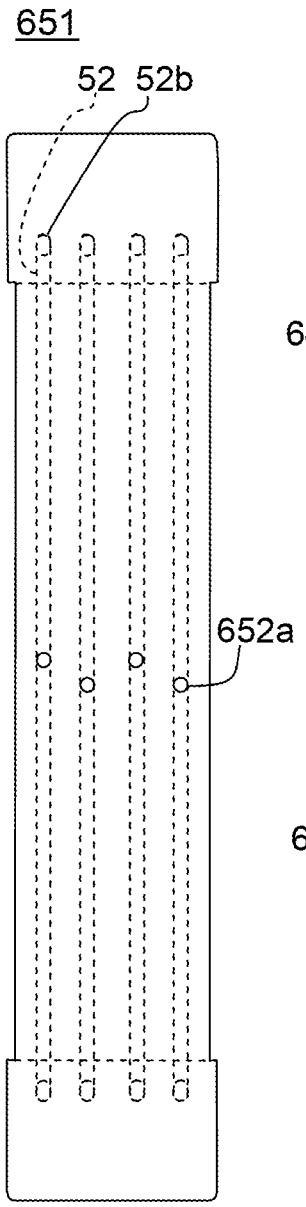
FIG. 11(*a*) is a branch passage member used in a reservoir of another liquid discharge head of the present invention, and FIG. 11(*b*) illustrates a passage structure used in a reservoir of another liquid discharge head of the present invention.
Figure 11B:
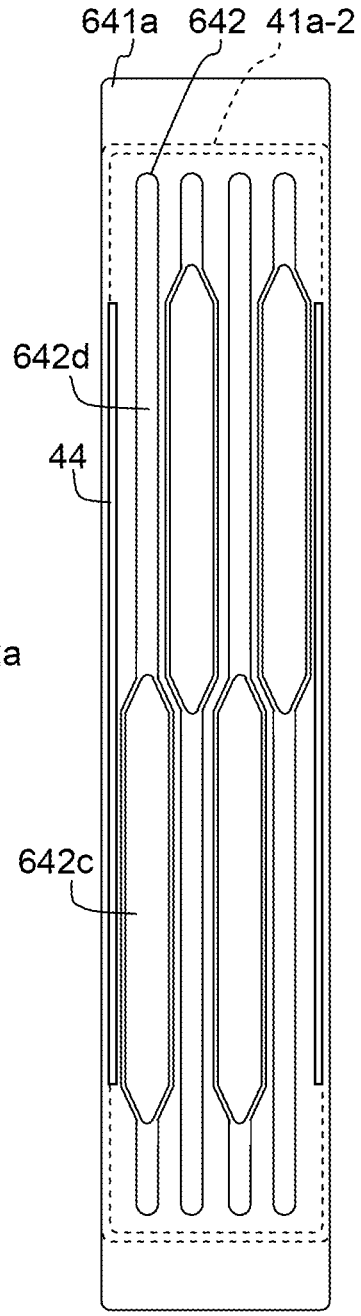

Subsequently, a liquid discharge head in accordance with another embodiment of the present invention will be described with reference to FIG. 11(*a*) and FIG. 11(*b*). The other liquid discharge head of the present invention can be obtained by replacing the branch passage member 51 of the liquid discharge head 2 in FIGS. 1 to 7 with a branch passage member 651 illustrated in FIG. 11(*a*) and the passage structure 41*a* with a passage structure 641*a* illustrated in FIG. 11(*a*).

Supply holes (central passages) 652*a* of the branch passage member 651 are provided in the central portion in the longitudinal direction, but are displaced from each other in the longitudinal direction. Since the supply holes 652*a* are separated from each other in this manner, even if a slight joining failure occurs in joining the passage structure 641*a* to the branch passage member 651, the adjacent supply holes 652*a* are hardly connected to each other, preventing mixture of liquid. In the case of joining using an adhesive, it is preferred to form a groove in at least one of the passage structure 641*a* and the branch passage member 651 such that an excessive adhesive run off the passage, and a space for a groove between the adjacent supply holes 652*a* can be increased. Further, since the distance between the adjacent supply holes 652*a* is large, by inserting an O ring around the connection, mixture of liquid can be further suppressed. By setting a displaced amount in the longitudinal direction to be ⅕, preferably, 1/10 of the length of the branch passage 52 or smaller, the difference in length between the branched branch passages 52 can be decreased. By meandering or skewing the branch passage 52 having a lower length to the outflow hole 52*b* to increase the length, the difference in length between the branched branch passages 52 can be further decreased.

By gradually varying the width of a broad section 642*c* and a narrow section 642*d* of the passage structure 641*a*, liquid can be smoothly passed. As a result, when liquid is first introduced, air bubbles and foreign materials can be prevented from remaining in reservoir passages 642. In such case, by making displacement of the supply holes 652*a* in the longitudinal direction on the opposite side to the broad section 642*c*, the damper 46 can be lengthened while keeping a certain thickness of the partition between the adjacent reservoir passages 642 or larger, thereby improving the damping effect. Moreover, the filter can be also lengthened, increasing throughput.

In this embodiment, the displacing elements 30 piezoelectrically deformed are illustrated as the pressurizing sections, the present invention is not limited to these, and for example, any member that can pressurize liquid in the pressurizing chambers 10, such as a member that heats and boils liquid in the pressurizing chambers 10 to generate pressure, and a member using MEMS (Micro Electro Mechanical Systems) may be adopted.

The above-mentioned liquid discharge head 2 is manufactured as follows, for example. A tape made of piezoelectric ceramic powders and an organic composition is molded according to any general tape molding method such as a roll coating method and a slit coating method, to manufacture a plurality of green sheets that become the piezoelectric ceramic layers 21*a* and 21*b* after baking. An electrode paste that becomes the common electrode 24 is formed on the surface of a part of the green sheet according to printing. A via hole is formed in a part of the green sheet as needed, and a via conductor is filled in the via hole.

Next, the green sheets are stacked to prepare a stacked body, and the stacked body is pressurized and tightly fixed. The pressurized and tightly fixed stacked body is baked in a high concentrated oxygen atmosphere and then, the individual electrode 25 is printed on the surface of the baked body by using an organic gold paste, and baked. After that, the connecting electrode 26 is printed using an Ag paste and baked to prepare the piezoelectric actuator board 21.

Next, the plates 4*a* to 4*i* made by rolling or the like are stacked via an adhesive layer to prepare the passage member 4. Holes that will become the manifolds 5, the individual supply passage 14, the pressurizing chambers 10, and the descenders are processed in the plates 4*a* to 4*i* into their predetermined shapes.

These plates 4*a* to 4*j* are desirably made of at least one type of metal selected from a group of Fe—Cr based, Fe—Ni based, and WC—TiC based metal, and especially when ink is used as liquid, the plates are desirably made of a material having a high corrosion resistance to ink and therefore, Fe—Cr based metal is more preferable.

The reservoir 40 is constituted by stacking and tightly fixing the passage structure 41*a* of the injection-molded reservoir body constituting the reservoir body 41, the metal plates 41*b* and 41*d* having various holes, the damper plate 41*c*, and the metal plates 51*a* to 51*c* having various holes, which constitute the stacked and tightly fixed branch passage member 51, and adhering the filter 48 thereto.

The piezoelectric actuator board 21 can be stacked and adhered to the passage member 4 by using, for example, an adhesive layer. Any well-known adhesive layer can be used and however, so as not to affect the piezoelectric actuator board 21 and the passage member 4, it is preferred to use at least one type of thermoset resin adhesive selected from a group consisting of epoxy resin, phenol resin, polyphenylene ether resin having a thermal curing temperature in the range of 100 to 150 oC. The piezoelectric actuator board 21 can be bonded to the passage member 4 by heating them up to the thermal curing temperature with use of such adhesive layer.

To electrically connect the piezoelectric actuator board 21 to the control circuit 100, a silver paste is supplied to the connecting electrode 26, an FPC as the signal transmitting section 92 on which the driver IC 55 is previously mounted is placed thereon, and the silver paste is cured by heating to be electrically connected. In the mounting, the driver IC 55 is electrically flip-chip connected to the FPC by means of soldering and then, is cured by supplying protective resin around the soldering.

Next, after passing the FPC through the through hole 44 of the reservoir 40, the reservoir 40 is adhered to the passage member 4. Any well-known adhesive layer can be used and however, so as not to affect the piezoelectric actuator board 21 and the passage member 4, it is preferred to use at least one type of thermoset resin adhesive selected from a group consisting of epoxy resin, phenol resin, polyphenylene ether resin having a thermal curing temperature in the range of 100 to 150 oC. The branch passage member 51 can be joined to the passage member 4 by heating them up to the thermal curing temperature with use of such adhesive layer. Thereby, the pressurizing-section storing section 54 is generated between the reservoir 40 and the passage member 4, and the piezoelectric actuator board 21 is stored in a substantially sealed space except for the through hole 44. After that, to enhance sealing, a sealant such as resin may fill between an edge 41*a*-2 of the concave section and the passage member 4.

Next, the pressing plate 96, to which the heat-insulating elastic member 95 is attached at a predetermined position with resin or the like, and the wiring board 94, on which the reservoir 40 and the signal cable previously electrically-connected to the connector 95 and the controller 100 is mounted, are fixed by use of screws. Then, the signal transmitting section 92 is bent, and one end of the signal transmitting section 92 is inserted into the connector 95 to be fixed there. After that, the housing 90 is fixed with a screw. The signal cable is drawn from a hole in the housing 90 to the outside. As needed, the region between the reservoir 40 and the passage member is sealed, and the hole through which the signal cable is drawn is closed with a resin part to complete the liquid discharge head 2.

What is claimed is:

1. A liquid discharge head comprising:

a long passage member in one direction, having a plurality of discharge holes and a plurality of pressurizing chambers connected to a plurality of the respective discharge holes;

a plurality of pressurizing sections joined to the passage member pressurizing liquid in a plurality of the respective pressurizing chambers; and a long reservoir in the one direction bonded along the passage member and having a reservoir passage for supplying the liquid to a plurality of the pressurizing chambers, and when viewed in the direction in which the reservoir and the passage member are bonded, the reservoir comprises a plurality of heat insulating sections extending in the one direction and a heat transfer section provided between a plurality of the heat insulating sections.

2. The liquid discharge head according to claim 1, wherein when viewed in the direction in which the reservoir and the passage member are bonded, the heat transfer section is provided at the central portion in a reservoir width direction orthogonal to the one direction.

3. The liquid discharge head according to claim 1, wherein a part or the whole of the heat insulating section is the reservoir passage.

4. The liquid discharge head according to claim 1, wherein a part of the heat insulating section is a space in the reservoir.

5. The liquid discharge head according to claim 1, wherein both ends of the reservoir in the one direction are connected to both ends of the passage member in the one direction.

6. The liquid discharge head according to claim 1, wherein when viewed in the direction in which the reservoir and the passage member are bonded, the reservoir is connected to the passage member so as to surround the periphery of the passage member.

7. The liquid discharge head according to claim 1, wherein the passage member includes a common passage, and the common passage extends in the one direction of the passage member and is connected to a plurality of the pressurizing chambers, and the reservoir passage is connected to the common passage so as to supply the liquid to both ends of the common passage.

8. The liquid discharge head according to claim 7, wherein the reservoir includes a branch passage, the branch passage extends in the one direction of the reservoir, a central portion of the branch passage is connected to a central portion of the reservoir passage, and both ends of the branch passage each are connected to the common passage of the passage member.

9. The liquid discharge head according to claim 1, wherein the heat transfer section is made of metal.

10. The liquid discharge head according to claim 1, wherein the reservoir is provided with a heater along the one direction.

11. A liquid discharge head comprising:

a long passage member in one direction having a plurality of discharge holes and a plurality of pressurizing chambers connected to a plurality of the respective discharge holes;

a plurality of pressurizing sections joined to the passage member and pressurizing liquid in a plurality of the respective pressurizing chambers; and a long reservoir in the one direction bonded along the passage member and having a plurality of reservoir passages for supplying liquid to a plurality of the pressurizing chambers and a plurality of dampers facing a plurality of the respective reservoir passages, wherein the reservoir passages each extend in the one direction, and have a broad section having a larger width from a central portion to one end than a width from the central portion to the other end, and a plurality of the reservoir passages are adjacent to each other in a direction intersecting the one direction, the broad sections of the adjacent reservoir passages are alternately disposed, and the dampers face the broad sections.

12. The liquid discharge head according to claim 11, wherein the broad sections each are provided with a filter.

13. The liquid discharge head according to claim 11, wherein the passage member includes a common passage, and the common passage extends in the one direction of the passage member and is connected to a plurality of the pressurizing chambers, and the reservoir includes a branch passage, the branch passage extends in the one direction of the reservoir, a central portion of the branch passage is connected to a central portion of the reservoir passage, and both ends of the branch passage each are connected to the common passage of the passage member.

14. The liquid discharge head according to claim 13, further comprising central passages connecting the central portions of the reservoir passages to the central portion of the branch passage, and the adjacent central passages are alternately displaced from each other in the one direction.

15. The liquid discharge head according to claim 14, wherein the central passages are disposed on the opposite side to the broad sections.

16. A recording device comprising:

the liquid discharge head according to claim 1;

a conveying section for conveying a record medium to the liquid discharge head; and a controller for controlling a plurality of pressurizing sections.

* * * * *